US006052470A

United States Patent [19]

Mouri

[11] Patent Number: 6,052,470

[45] Date of Patent: Apr. 18, 2000

[54] SYSTEM FOR PROCESSING AUDIO SURROUND SIGNAL

[75] Inventor: Tomohiro Mouri, Tokyo, Japan

[73] Assignee: Victor Company of Japan, Ltd., Yokohama, Japan

[21] Appl. No.: 08/922,526

[22] Filed: Sep. 3, 1997

[30] Foreign Application Priority Data

Sep. 4, 1996 [JP] Japan ..... 8-253826

[51] Int. Cl.[7] ..... H04R 5/00

[52] U.S. Cl. ..... 381/18; 381/1; 381/17

[58] Field of Search ..... 381/1, 17, 18, 381/19, 20, 21, 22, 63

[56] References Cited

U.S. PATENT DOCUMENTS

| | | | |
|---|---|---|---|
| 3,746,492 | 7/1973 | Scheiber . | |
| 4,159,397 | 6/1979 | Iwahara et al. . | |
| 4,188,504 | 2/1980 | Kasuga et al. . | |
| 4,349,698 | 9/1982 | Iwahara . | |
| 4,589,129 | 5/1986 | Blackmer | 381/21 |
| 5,043,970 | 8/1991 | Holman | 381/20 |
| 5,052,685 | 10/1991 | Lowe et al. | 381/17 |
| 5,095,507 | 3/1992 | Lowe | 381/17 |
| 5,222,059 | 6/1993 | Holman | 381/20 |
| 5,319,713 | 6/1994 | Waller, Jr. et al. | 381/22 |
| 5,381,482 | 1/1995 | Matsumoto et al. | 381/63 |
| 5,404,406 | 4/1995 | Fuchigami et al. . | |
| 5,546,465 | 8/1996 | Kim | 381/18 |
| 5,579,396 | 11/1996 | Iida et al. | 381/18 |
| 5,727,067 | 3/1998 | Iwamatsu | 381/18 |
| 5,844,993 | 12/1998 | Iida et al. | 381/17 |

FOREIGN PATENT DOCUMENTS 8051698 2/1996 Japan .

OTHER PUBLICATIONS

"AC–3: Flexible Perceptual Coding for Audio Transmission and Storage", by Craig C. Todd et al; Presented at the 96th Convention 1994 Feb. 26–Mar. 1 Amsterdam; An Audio Engineering Society Preprint.

*Primary Examiner*—Forester W. Isen
*Assistant Examiner*—Xu Mei
*Attorney, Agent, or Firm*—Pollock, Vande Sande & Amernick

[57] ABSTRACT

A surround signal processing system receives a surround signal and also a program of processing the surround signal. The received surround signal is decoded into multiple-channel signals according to the received program. The multiple-channel signals include a left surround signal and a right surround signal. The multiple-channel signals are converted into two-channel signals according to the received program. The two-channel signals are transmitted to a pair of loudspeakers respectively. During the conversion of the multiple-channel signals into the two-channel signals, the left surround signal and the right surround signal are subjected to filtering processes according to the received program so that the left surround signal and the right surround signal will be converted into filtering-resultant signals. The two-channel signals are generated on the basis of the filtering-resultant signals. The filtering processes are designed to localize sound images at rear positions symmetrical with respect to a listener when a rear loudspeaker is absent and only front loudspeakers are used.

26 Claims, 19 Drawing Sheets

SYSTEM FOR PROCESSING AUDIO SURROUND SIGNAL

BACKGROUND OF THE INVENTION

1. Field of the Invention

This invention relates to a system for processing a surround signal. This invention relates to a method of processing a surround signal. This invention relates to an information recording medium which stores a surround signal processing program. This invention relates to a transmission system for a surround signal processing program. This invention relates to a reception system for a surround signal processing program. This invention relates to an apparatus for recording a surround signal. This invention relates to a method of recording a surround signal. This invention relates to a recording apparatus for a surround signal processing program.

2. Description of the Related Art

Systems for recovering multiple-channel audio signals are of several types such as the 3-1 type in High-Vision and the 4-channel matrix type based on Dolby surround. Many motion-picture films have surround tracks which carry surround information resulting from Dolby surround audio processing. In a motion-picture theater, sound information is reproduced from a surround track, and the reproduced sound information is decoded into multiple-channel sound signals. The sound signals are fed to loudspeakers before being converted into corresponding sounds, respectively. The loudspeakers include front loudspeakers and also a rear loudspeaker to provide the surround effect.

There are commercially available video tapes and laser discs which are made on the basis of such motion-picture films by steps including a step of copying sound information. These video tapes and laser discs store sound information which results from surround audio processing such as Dolby surround audio processing.

In a prior-art 4-channel surround audio system, since a rear sound signal (a surround signal) is monaural, it tends to be difficult to accurately express a feeling of certain types of forward or backward movement of a sound image. According to Dolby surround, since the 4-channel matrix is analog, perfect decoding tends to be difficult. In the prior-art 4-channel surround audio system, the frequency band of a surround track is considerably limited to prevent crosstalk.

Craig C. Todd et al in Dolby Laboratories have proposed a 5-channel audio format, "AC-3", which is also called "Dolby digital". According to the AC-3 format, rear sound is represented by discrete surround signals.

Specifically, according to the AC-3 format, a left signal, a right signal, a center signal, a left surround signal, and a right surround signal form a set of 5-channel signals which are multiplexed before being transmitted. Signals of the AC-3 format can be recorded on surround tracks in conventional package recording media.

During the reproduction of information from a conventional package recording medium having a surround track, sound information is reproduced from the surround track, and is decoded into 4-channel signals of Dolby surround or 5-channel signals of Dolby digital. It is known to convert such 4-channel signals or 5-channel signals into only 2-channel signals for an audio system without any rear loudspeaker. The 2-channel signals are fed to two front loudspeakers, respectively. The conversion of the 4-channel signals or the 5-channel signals into the 2-channel signals is designed to provide a virtual rear loudspeaker or virtual rear loudspeakers for the surround effect.

Japanese published unexamined patent application 8-51698 discloses a surround signal processor for 5-channel signals including a left surround signal and a right surround signal. The surround signal processor is followed by two loudspeakers. The surround signal processor converts the 5-channel signals into 2-channel signals which are fed to the two loudspeakers respectively. The surround signal processor includes a first adder, a second adder, a first subtracter, a second subtracter, a first filter, and a second filter. In the surround signal processor of Japanese application 8-51698, the first adder adds the left surround signal and the right surround signal, and outputs a signal representing the sum of the left surround signal and the right surround signal. The first subtracter subtracts the right surround signal from the left surround signal, and outputs a signal representing the difference between the left surround signal and the right surround signal. The first filter processes the output signal of the first adder. The second filter processes the output signal of the first subtracter. The second adder adds the output signal of the first filter and the output signal of the second filter, and outputs a signal representing the sum of the output signal of the first filter and the output signal of the second filter. The second subtracter subtracts the output signal of the second filter from the output signal of the first filter, and outputs a signal representing the difference between the output signal of the first filter and the output signal of the second filter. The output signal of the second adder and the output signal of the second subtracter are fed to the loudspeakers respectively. Transmission characteristics P of the first filter and transmission characteristics N of the second filter are set as $P=(F+K)/(S+A)$ and $N=(F-K)/(S-A)$, where "S" denotes transmission characteristics of the path from the couples of the loudspeakers to the ear of a listener on one side; "A" denotes transmission characteristics of the path from the couples of the loudspeakers to the ear on the opposite side; "F" denotes transmission characteristics of the path from a desired position of a localized rear sound image to the ear of the listener on one side; and "K" denotes transmission characteristics of the path from the desired position of the localized rear sound image to the ear on the opposite side.

A second surround signal processor disclosed in Japanese application 8-51698 serves to process 5-channel signals having a left surround signal and a rear surround signal. The surround signal processor is followed by two loudspeakers. The surround signal processor includes four sound image localizing filters. The left surround signal is transmitted to the two loudspeakers via two sound image localizing filters, respectively. The right surround signal is transmitted to the two loudspeakers via two sound image localizing filters, respectively.

SUMMARY OF THE INVENTION

It is an object of this invention to provide an improved system for processing an audio surround signal.

A first aspect of this invention provides a surround signal processing system comprising first means for receiving a surround signal; second means for receiving a program of processing the surround signal; third means for decoding the surround signal received by the first means into multiple-channel signals according to the program received by the second means, the multiple-channel signals including a left surround signal and a right surround signal; fourth means for converting the multiple-channel signals generated by the third means into two-channel signals according to the program received by the second means; a pair of loudspeakers; and fifth means for transmitting the two-channel signals generated by the fourth means to the loudspeakers respectively; wherein the fourth means comprises means for subjecting the left surround signal and the right surround signal generated by the third means to filtering processes according to the program received by the second means to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals.

A second aspect of this invention is based on the first aspect thereof, and provides a surround signal processing system wherein the second means comprises a disc drive for reading out the program from an information recording disc.

A third aspect of this invention is based on the first aspect thereof, and provides a surround signal processing system wherein the second means comprises a terminal device connected to a communication network for receiving the program from the communication network.

A fourth aspect of this invention provides a method of processing a surround signal, comprising the steps of receiving a surround signal; receiving a program of processing a surround signal; decoding the received surround signal into multiple-channel signals according to the received program, the multiple-channel signals including a left surround signal and a right surround signal; converting the multiple-channel signals into two-channel signals according to the received program; and transmitting the two-channel signals to a pair of loudspeakers respectively; wherein the converting step comprises the step of subjecting the left surround signal and the right surround signal to filtering processes according to the received program to convert the left surround signal and the right surround signal into filtering-resultant signals, the filtering processes being designed to localize sound images at rear positions symmetrical with respect to a listener when a rear loudspeaker is absent and only front loudspeakers are used, and the step of generating the two-channel signals on the basis of the filtering-resultant signals.

A fifth aspect of this invention is based on the fourth aspect thereof, and provides a method wherein the program receiving step comprises the step of reading out the program from an information recording disc.

A sixth aspect of this invention is based on the fourth aspect thereof, and provides a method wherein the program receiving step comprises the step of receiving the program from a communication network.

A seventh aspect of this invention provides an information recording medium which stores a program of processing a surround signal, the program including a step for decoding the surround signal into multiple-channel signals, the multiple-channel signals including a left surround signal and a right surround signal, and a step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used.

An eighth aspect of this invention provides an information recording medium having a first data recording area and a second data recording area separate from the first data recording area, the first data recording area storing a surround signal, the second data recording area storing a program of processing the surround signal, the program including a step for decoding the surround signal into multiple-channel signals, the multiple-channel signals including a left surround signal and a right surround signal, and a step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used.

A ninth aspect of this invention provides a transmission system for a surround signal processing program, comprising first meas for storing a program of processing a surround signal, the program including a step for decoding the surround signal into multiple-channel signals, the multiple-channel signals including a left surround signal and a right surround signal, and a step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used; a terminal device connected to a communication network; and second means connected to the first means and the terminal device for transmitting the program from the first means to the communication network via the terminal device.

A tenth aspect of this invention provides a reception system for a surround signal processing program, comprising a terminal device connected to a communication network; and means connected to the terminal device for receiving a program from the communication network via the terminal device; wherein the program includes a step for decoding a surround signal into multiple-channel signals, the multiple-channel signals including a left surround signal and a right surround signal, and a step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used.

An eleventh aspect of this invention provides a recording apparatus for a surround signal, comprising first means for decoding a surround signal into multiple-channel signals, the multiple-channel signals including a left surround signal and a right surround signal; second means for converting the multiple-channel signals generated by the first means into two-channel signals; and third means for recording the two-channel signals generated by the second means on a recording medium; wherein the second means comprises means for subjecting the left surround signal and the right surround signal generated by the first means to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals.

A twelfth aspect of this invention provides a method of recording a surround signal, comprising the steps of decoding a surround signal into multiple-channel signals, the multiple-channel signals including a left surround signal and a right surround signal; converting the multiple-channel signals into two-channel signals; and recording the two-channel signals on a recording medium; wherein the converting step comprises the step of subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and the step of generating the two-channel signals on the basis of the filtering-resultant signals.

A thirteenth aspect of this invention provides a recording apparatus for a surround signal processing program, comprising first means for encoding a surround signal processing program into an encoding-resultant signal having a form suited for record; and second means for recording the encoding-resultant signal generated by the first means on an information recording medium; wherein the surround signal processing program includes a step for decoding a surround signal into multiple-channel signals, the multiple-channel signals including a left surround signal and a right surround signal, and a step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used.

DESCRIPTION OF THE PREFERRED EMBODIMENTS

First Embodiment

Figure 1:
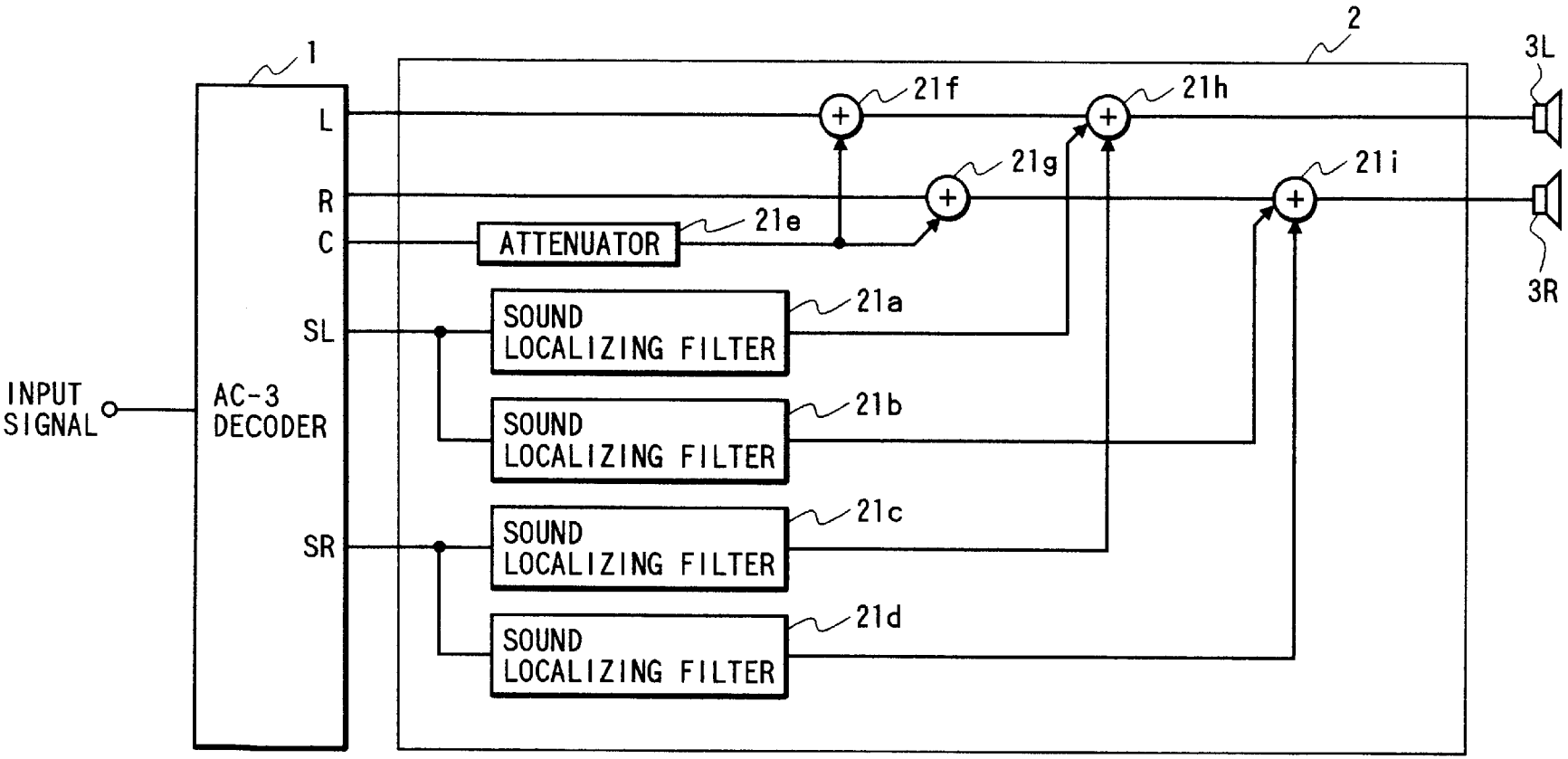
FIG. 1 is a block diagram of a surround signal processing system according to a first embodiment of this invention.

With reference to FIG. 1, an AC-3 decoder 1 receives an input digital audio signal of the AC-3 format, and decodes the input digital audio signal into a left signal L, a right signal R, a center signal C, a left surround signal SL, a right surround signal SR, and a subwoofer signal in a know way. Generally, the left signal L, the right signal R, the center signal C, the left surround signal SL, the right surround signal SR, and the subwoofer signal are analog. The left signal L, the right signal R, the center signal C, the left surround signal SL, and the right surround signal SR form a set of 5-channel signals. The left surround signal SL and the right surround signal SR are rear signals while the left signal L and the right signal R are front signals. The subwoofer signal has a frequency variable in the range equal to or lower than 100 Hz. The subwoofer signal is not used by a subsequent stage.

A signal processing circuit 2 follows the AC-3 decoder 1. The signal processing circuit 2 receives the left signal L, the right signal R, the center signal C, the left surround signal SL, and the right surround signal SR from the AC-3 decoder 1. The signal processing circuit 2 converts the 5-channel signals L, R, C, SL, and SR into 2-channel signals which are fed to two loudspeakers 3L and 3R respectively. The signal processing circuit 2 includes filters 21*a*, 21*b*, 21*c*, and 21*d*, an attenuator 21*e*, and adders 21*f*, 21*g*, 21*h*, and 21*i*.

The adder 21*f* receives the left signal L from the AC-3 decoder 1. The adder 21*g* receives the right signal R from the AC-3 decoder 1. The attenuator 21*e* receives the center signal C from the AC-3 decoder 1, and attenuates the center signal C by 3 dB. The attenuator 21*e* outputs the attenuation-resultant center signal to the adders 21*f* and 21*g*. The adder 21*f* adds the left signal L and the output signal of the attenuator 21*e*. The adder 21*f* outputs the addition-resultant signal to the adder 21*h*. The adder 21*g* adds the right signal R and the output signal of the attenuator 21*e*. The adder 21*g* outputs the addition-resultant signal to the adder 21*i*.

The filter 21*a* receives the left surround signal SL from the AC-3 decoder 1. The filter 21*a* subjects the left surround signal SL to a given filtering process of localizing a rear sound image on the left side of a listener. The filter 21*a* outputs the filtering-resultant signal to the adder 21*h*. The filter 21*b* receives the left surround signal SL from the AC-3 decoder 1. The filter 21*b* subjects the left surround signal SL to a given filtering process of localizing a rear sound image on the left side of the listener. The filter 21*b* outputs the filtering-resultant signal to the adder 21*i*. The filter 21*c* receives the right surround signal SR from the AC-3 decoder 1. The filter 21*c* subjects the right surround signal SR to a given filtering process of localizing a rear sound image on the right side of the listener. The filter 21*c* outputs the filtering-resultant signal to the adder 21*h*. The filter 21*d* receives the right surround signal SR from the AC-3 decoder 1. The filter 21*d* subjects the right surround signal SR to a given filtering process of localizing a rear sound image on the right side of the listener. The filter 21*d* outputs the filtering-resultant signal to the adder 21*i*.

The filters 21*a* and 21*b* include a pair of convolvers in which filter coefficients are set on the basis of transfer functions related to sound paths to the listener. Similarly, the filters 21*c* and 21*d* include a pair of convolvers in which filter coefficients are set on the basis of transfer functions related to sound paths to the listener.

The adder 21*h* adds the output signal of the adder 21*f*, the output signal of the filter 21*a*, and the output signal of the filter 21*c*. The adder 21*h* outputs the addition-resultant signal. The adder 21*i* adds the output signal of the adder 21*g*, the output signal of the filter 21*b*, and the output signal of the filter 21*d*. The adder 21*i* outputs the addition-resultant signal.

A pair of a left loudspeaker 3L and a right loudspeaker 3R follow the signal processing circuit 2. Specifically, the left loudspeaker 3L follows the adder 21*h* in the signal processing circuit 2. The right loudspeaker 3R follows the adder 21*i* in the signal processing circuit 2. The left loudspeaker 3L receives the output signal of the adder 21*h*, and converts the received signal into corresponding sound. The right loudspeaker 3R receives the output signal of the adder 21*i*, and converts the receives signal into corresponding sound. For example, the left loudspeaker 3L and the right loudspeaker 3R are provided in a television receiver.

Generally, the left loudspeaker 3L and the right loudspeaker 3R are placed in front of the listener. As will be made clear later, the processing of the signals applied to the front loudspeakers 3L and 3R provides a virtual rear left loudspeaker and a virtual rear right loudspeaker which enable the surround effects. In addition, the processing of the signals applied to the front loudspeakers 3L and 3R provides a virtual front center loudspeaker.

Figure 2:
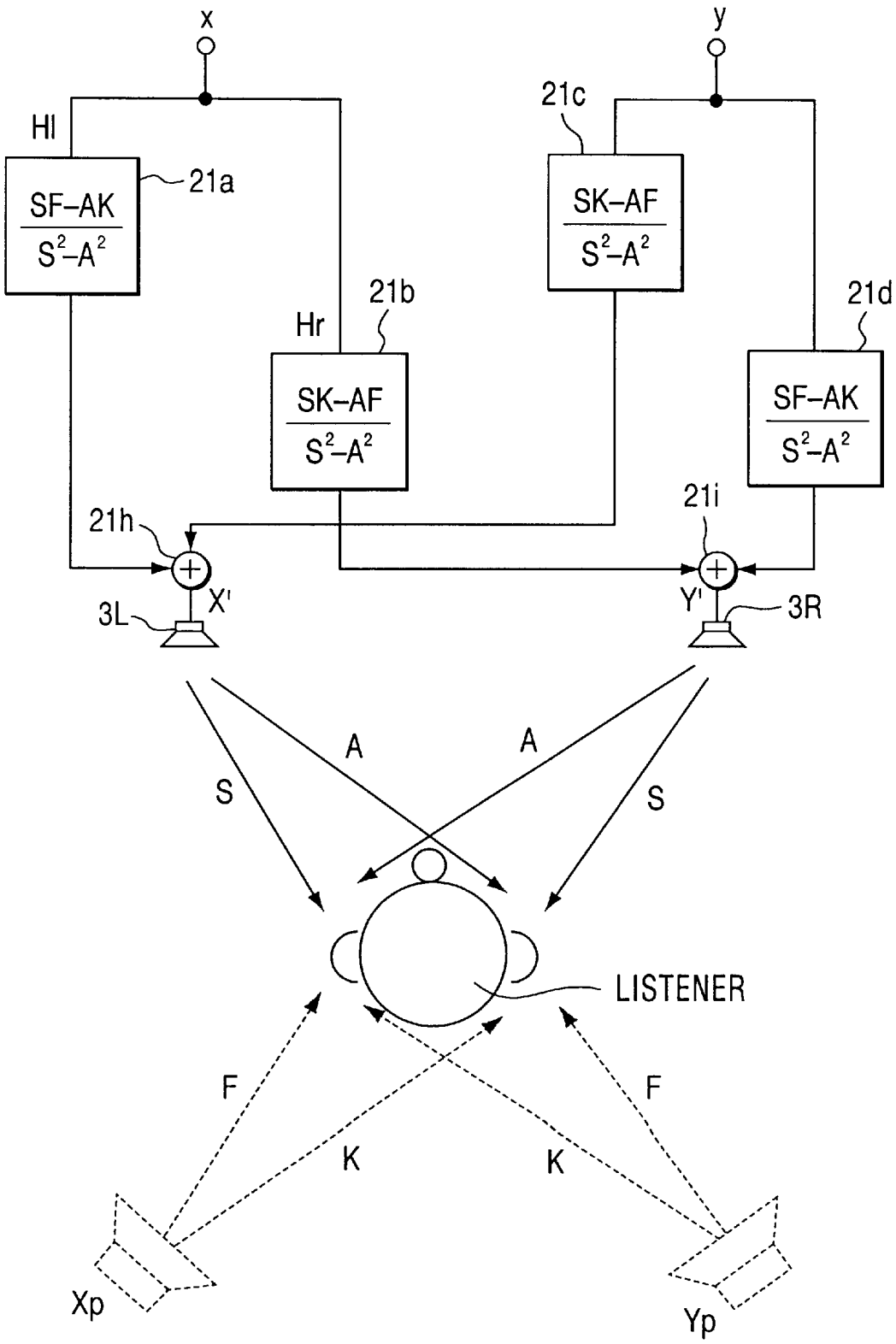
FIG. 2 is a diagram of a portion of the system in FIG. 1 and a listener.

With reference to FIG. 2, the filters 21*a*, 21*b*, 21*c*, and 21*d* are FIR filters having portions of the Atal-Schroeder type. The filters 21*a*, 21*b*, 21*c*, and 21*d* are designed to localize rear sound images and also to cancel crosstalk between channels related to the loudspeakers 3L and 3R. A set of the filters 21*a* and 21*b* is similar in design and structure to a set of the filters 21*c* and 21*d*. Accordingly, only a set of the filters 21*a* and 21*b* will be explained in detail.

Figure 3:
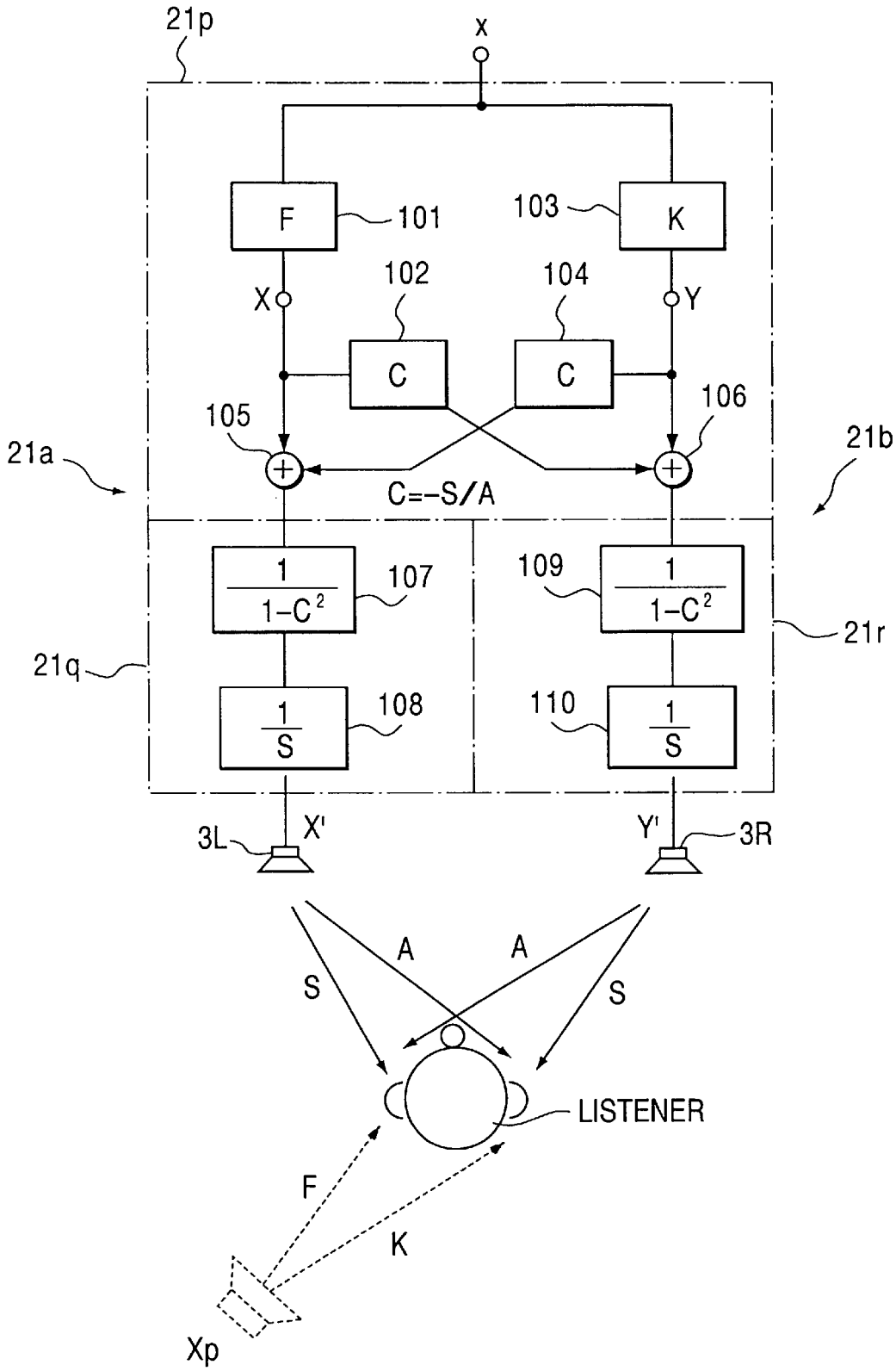
FIG. 3 is a diagram of a portion of the system in FIG. 1 and a listener.

As shown in FIG. 3, the filter 21*a* has a common portion 21*p* and an exclusive portion 21*q*. The filter 21*b* has the common portion 21*p* and an exclusive portion 21*r*. The common portion 21*p* includes filtering elements 101, 102, 103, and 104, and adders 105 and 106. The left surround signal SL is fed to the filtering elements 101 and 103, being filtered thereby. The function of the filtering element 101 corresponds to convolution with a transfer function "F". The function of the filtering element 103 corresponds to convolution with a transfer function "K". The output signal of the filtering element 101 is fed to the filtering element 102, being filtered thereby. The function of the filtering element 102 corresponds to convolution with a result "C" of operation "−S/A", where "S" and "A" denote transfer functions, and "/" denotes inverse convolution. The output signal of the filtering element 103 is fed to the filtering element 104, being filtered thereby. The function of the filtering element 104 corresponds to convolution with a result "C" of operation "−S/A". The output signal of the filtering element 101 and the output signal of the filtering element 104 are fed to the adder 105, being added thereby. The output signal of the filtering element 103 and the output signal of the filtering element 102 are fed to the adder 106, being added thereby.

The exclusive portion 21*q* of the filter 21*a* includes filtering elements 107 and 108. The output signal of the adder 105 is fed to the filtering element 107, being filtered thereby. The function of the filtering element 107 corresponds to convolution with a result of operation "$1/(1-C^2)$". The output signal of the filtering element 107 is fed to the filtering element 108, being filtered thereby. The function of the filtering element 108 corresponds to convolution with a result of operation "1/S". The output signal of the filtering element 108 is fed to the left loudspeaker 3L.

The exclusive portion 21*r* of the filter 21*b* includes filtering elements 109 and 110. The output signal of the adder 106 is fed to the filtering element 109, being filtered thereby. The function of the filtering element 109 corresponds to convolution with a result of operation "$1/(1-C^2)$". The output signal of the filtering element 109 is fed to the filtering element 110, being filtered thereby. The function of the filtering element 110 corresponds to convolution with a result of operation "1/S". The output signal of the filtering element 110 is fed to the right loudspeaker 3R.

The filtering elements 101 and 103 serve as sound image localizing filters. The filtering elements 102, 104, 107, 108, 109, and 110, and the adders 105 and 106 compose a crosstalk canceling filter array.

With reference to FIGS. 2 and 3, the loudspeakers 3L and 3R are located at positions symmetrical with respect to the listener. At the left ear of the listener, the resultant xO of the sound output X' from the left loudspeaker 3L and the sound output Y' from the right loudspeaker 3R is given by the following equation.

$$x0=SX'+AY' \quad (1)$$

where "S" denotes the transfer function of a sound path from the left loudspeaker 3L to the left ear of the listener, and "A" denotes the transfer function of a sound path from the right loudspeaker 3R to the left ear of the listener. The transfer functions "S" and "A" are predetermined according experiments. At the right ear of the listener, the resultant y0 of the sound output X' from the left loudspeaker 3L and the sound output Y' from the right loudspeaker 3R is given by the following equation.

$$y0=AX'+SY' \quad (2)$$

where "S" denotes the transfer function of a sound path from the right loudspeaker 3R to the right ear of the listener, and "A" denotes the transfer function of a sound path from the left loudspeaker 3L to the right ear of the listener.

An explanation will be given of filter designing in connection with conditions of canceling crosstalk. With reference to FIG. 3, in the case where the resultant x0 is equivalent to the output signal X of the filtering element 101 (that is, the signal inputted to the crosstalk canceling filter array), "X" is substituted for "x0" in the equation (1) so that the equation (1) is changed to the following equation.

$$X=SX'+AY' \quad (3)$$

In the case where the resultant y0 is equivalent to the output signal Y of the filtering element 103 (that is, the signal inputted to the crosstalk canceling filter array), "Y" is substituted for "y0" in the equation (2) so that the equation (2) is changed to the following equation.

$$Y=AX'+SY' \quad (4)$$

By referring to the equations (3) and (4), the sound output X' from the left loudspeaker 3L and the sound output Y' from the right loudspeaker 3R are expressed as follows.

$$X'=(SX-AY)/(S^2-A^2) \quad (5)$$

$$Y'=(SY-AX)/(S^2-A^2) \quad (6)$$

An explanation will be given of filter designing in connection with sound image localization. With reference to FIGS. 2 and 3, it is assumed that a source signal "x" is generated at a desired position Xp of a virtual rear left loudspeaker, that is, a desired position Xp where a rear sound image is localized. In this case, a sound signal which appears at the left ear of the listener is expressed as a convolution result "Fx", where "F" denotes the transfer function of a sound path from the desired position Xp to the left ear of the listener. A sound signal which appears at the right ear of the listener is expressed as a convolution result "Kx", where "K" denotes the transfer function of a sound path from the desired position Xp to the right ear of the listener. The transfer functions "F" and "K" are predetermined according to experiments.

When the convolution results "Fx" and "Kx" are substituted for "X" and "Y" in the equations (5) and (6) respectively, sound image localization is implemented. In this case, the equations (5) and (6) are changed to the following equations.

$$X'=\{(SF-AK)/(S^2-A^2)\}\bullet x \quad (7)$$

$$Y'=\{(SK-AF)/(S^2-A^2)\}\bullet x \quad (8)$$

Accordingly, the filter coefficient Hl related to the filter 21*a* and the filter coefficient Hr related to the filter 21*b* are given as follows.

$$Hl=(SF-AK)/(S^2-A^2) \quad (9)$$

$$Hr=(SK-AF)/(S^2-A^2) \quad (10)$$

Similarly, the filter coefficient related to the filter 21*c* is equal to "Hr" expressed by the equation (10) while the filter coefficient related to the filter 21*d* is equal to "Hl" expressed by the equation (9).

With reference back to FIG. 1, the left signal L is transmitted from the AC-3 decoder 1 to the left loudspeaker 3L via the adders 21*f* and 21*h* in the signal processing circuit 2. The left signal L is converted into corresponding sound by the left loudspeaker 3L. The right signal R is transmitted from the AC-3 decoder 1 to the right loudspeaker 3R via the adders 21*g* and 21*i* in the signal processing circuit 2. The right signal R is converted into corresponding sound by the right loudspeaker 3R. The center signal C is fed from the AC-3 decoder 1 to the attenuator 21*e* in the signal processing circuit 2, being therefore attenuated by 3 dB. The attenuation-resultant center signal C is equally distributed to the loudspeakers 3L and 3R via the adders 21*f*, 21*g*, 21*h*, and 21*i* in the signal processing circuit 2. The attenuation-resultant center signal C is equally converted into corresponding sound by the loudspeakers 3L and 3R. The left surround signal SL is fed from the AC-3 decoder 1 to the filters 21*a* and 21*b* in the signal processing circuit 2. The left surround signal SL is subjected by the filters 21*a* and 21*b* to a left sound image localizing process and also a crosstalk canceling process. The output signal of the filter 21*a* is added to the left signal L and the attenuation-resultant center signal C by the adder 21*h*. The addition-resultant signal is transmitted to the left loudspeaker 3L before being converted thereby into corresponding sound. The output signal of the filter 21*b* is added to the right signal R and the attenuation-resultant center signal C by the adder 21*i*. The addition-resultant signal is transmitted to the right loudspeaker 3R before being converted thereby into corresponding sound. The right surround signal SR is subjected by the filters 21*c* and 21*d* to a right sound image localizing process and also a crosstalk canceling process. The output signal of the filter 21*c* is added to the left signal L and the attenuation-resultant center signal C by the adder 21*h*. The addition-resultant signal is transmitted to the left loudspeaker 3L before being converted thereby into corresponding sound. The output signal of the filter 21*d* is added to the right signal R and the attenuation-resultant center signal C by the adder 21*i*. The addition-resultant signal is transmitted to the right loudspeaker 3R before being converted thereby into corresponding sound.

Figure 4:
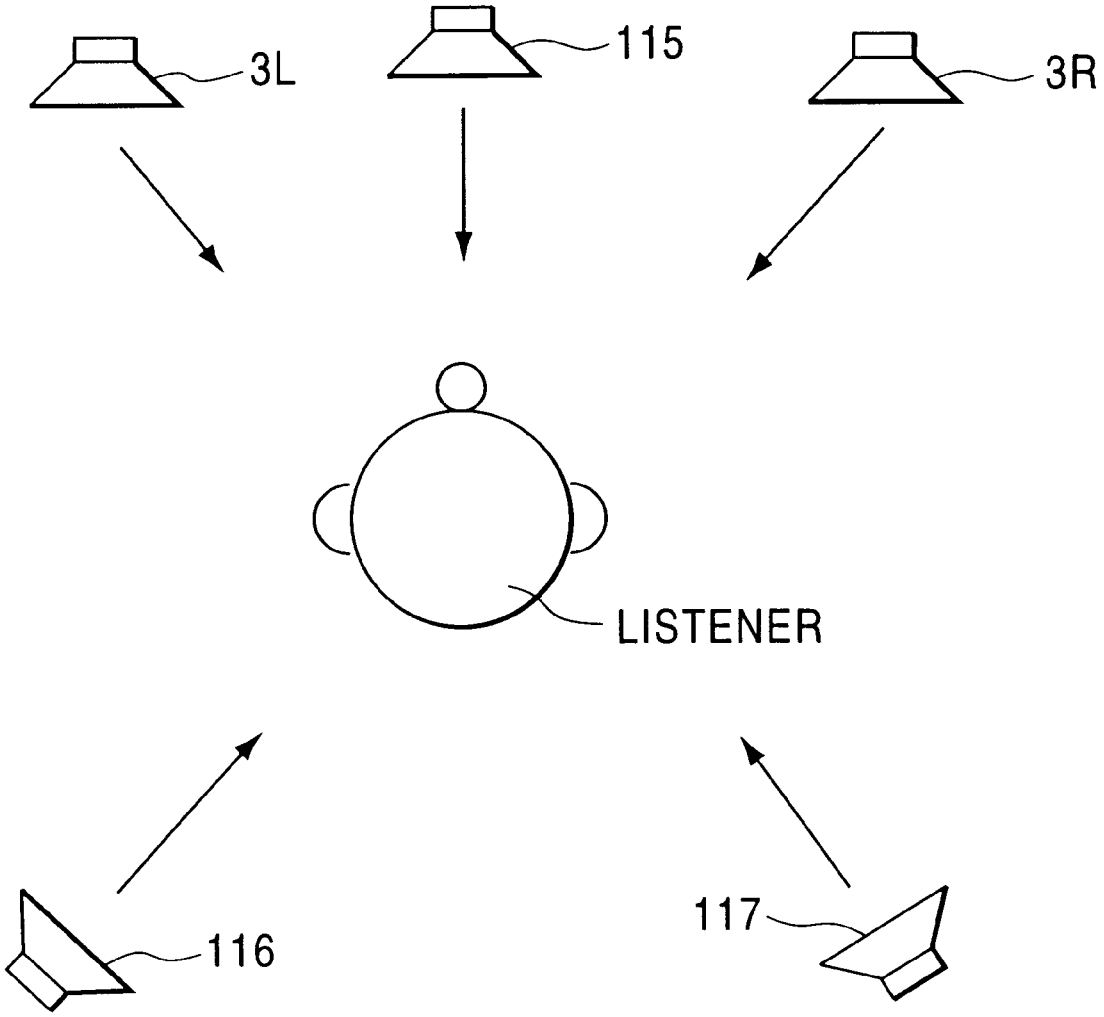
FIG. 4 is a diagram of real and virtual loudspeakers in the system of FIG. 1, and a listener.

As shown in FIG. 4, in addition to real loudspeakers formed by the front left loudspeaker 3L and the front right loudspeaker 3R, there are provided three virtual loudspeakers, that is, a virtual front center loudspeaker 115, a virtual rear left loudspeaker 116, and a virtual rear right loudspeaker 117. The listener can feel as if sound represented by the center signal C, sound represented by the left surround signal SL, and sound represented by the right surround signal SR are generated by the virtual front center loudspeaker 115, the virtual rear left loudspeaker 116, and the virtual rear right loudspeaker 117, respectively.

It should be noted that the AC-3 decoder 1 and the signal processing circuit 2 can be formed by a digital signal processor (DSP) having a combination of an input/output port, a processing section, a ROM, and a RAM. In this case, the AC-3 decoder 1 and the signal processing circuit 2 operate in accordance with a program stored in the ROM. The program is designed to implement the previously-indicated functions of the AC-3 decoder 1 and the signal processing circuit 2. The program is also referred to as an AC-3 surround signal processing program.

Second Embodiment

Figure 5:
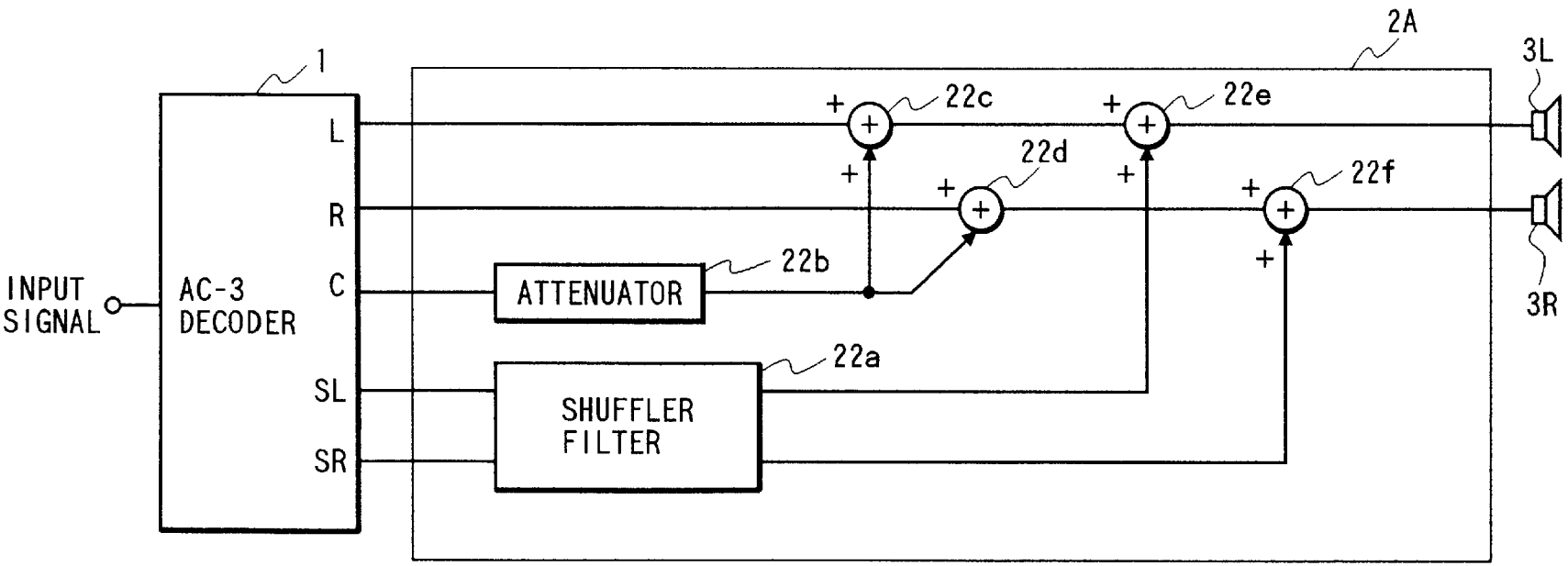
FIG. 5 is a block diagram of a surround signal processing system according to a second embodiment of this invention.

With reference to FIG. 5, an AC-3 decoder 1 receives an input digital audio signal of the AC-3 format, and decodes the input digital audio signal into a left signal L, a right signal R, a center signal C, a left surround signal SL, a right surround signal SR, and a subwoofer signal in a know way. Generally, the left signal L, the right signal R, the center signal C, the left surround signal SL, the right surround signal SR, and the subwoofer signal are analog. The left signal L, the right signal R, the center signal C, the left surround signal SL, and the right surround signal SR form a set of 5-channel signals. The left surround signal SL and the right surround signal SR are rear signals while the left signal L and the right signal R are front signals. The subwoofer signal has a frequency variable in the range equal to or lower than 100 Hz. The subwoofer signal is not used by a subsequent stage.

A signal processing circuit 2A follows the AC-3 decoder 1. The signal processing circuit 2A receives the left signal L, the right signal R, the center signal C, the left surround signal SL, and the right surround signal SR from the AC-3 decoder 1. The signal processing circuit 2A converts the 5-channel signals L, R, C, SL, and SR into 2-channel signals which are fed to two loudspeakers 3L and 3R respectively.

The signal processing circuit 2A includes a shuffler filter 22*a*, an attenuator 22*b*, and adders 22*c*, 22*d*, 22*e*, and 22*f*.

The adder 22*c* receives the left signal L from the AC-3 decoder 1. The adder 22*d* receives the right signal R from the AC-3 decoder 1. The attenuator 22*b* receives the center signal C from the AC-3 decoder 1, and attenuates the center signal C by 3 dB. The attenuator 22*b* outputs the attenuation-resultant center signal to the adders 22*c* and 22*d*. The adder 22*c* adds the left signal L and the output signal of the attenuator 22*b*. The adder 22*c* outputs the addition-resultant signal to the adder 22*e*. The adder 22*d* adds the right signal R and the output signal of the attenuator 22*b*. The adder 22*d* outputs the addition-resultant signal to the adder 22*f*.

The shuffler filter 22*a* receives the left surround signal SL and the right surround signal SR from the AC-3 decoder 1. The shuffler filter 22*a* converts the left surround signal SL and the right surround signal SR into a left-channel signal and a right-channel signal by a shuffling process of localizing rear sound images on the left side and the right side of the listener. The shuffler filter 22*a* outputs the left-channel signal to the adder 22*e*. The shuffler filter 22*a* outputs the right-channel signal to the adder 22*f*.

The adder 22*e* adds the output signal of the adder 22*c* and the left-channel output signal of the shuffler filter 22*a*. The adder 22*e* outputs the addition-resultant signal. The adder 22*f* adds the output signal of the adder 22*d* and the right-channel output signal of the shuffler filter 22*a*. The adder 22*f* outputs the addition-resultant signal.

A pair of a left loudspeaker 3L and a right loudspeaker 3R follow the signal processing circuit 2A. Specifically, the left loudspeaker 3L follows the adder 22*e* in the signal processing circuit 2A. The right loudspeaker 3R follows the adder 22*f* in the signal processing circuit 2A. The left loudspeaker 3L receives the output signal of the adder 22*e*, and converts the received signal into corresponding sound. The right loudspeaker 3R receives the output signal of the adder 22*f*, and converts the receives signal into corresponding sound. For example, the left loudspeaker 3L and the right loudspeaker 3R are provided in a television receiver.

Generally, the left loudspeaker 3L and the right loudspeaker 3R are placed in front of the listener. As will be made clear later, the processing of the signals applied to the front loudspeakers 3L and 3R provides a virtual rear left loudspeaker and a virtual rear right loudspeaker which enable the surround effects. In addition, the processing of the signals applied to the front loudspeakers 3L and 3R provides a virtual front center loudspeaker.

Figure 6:
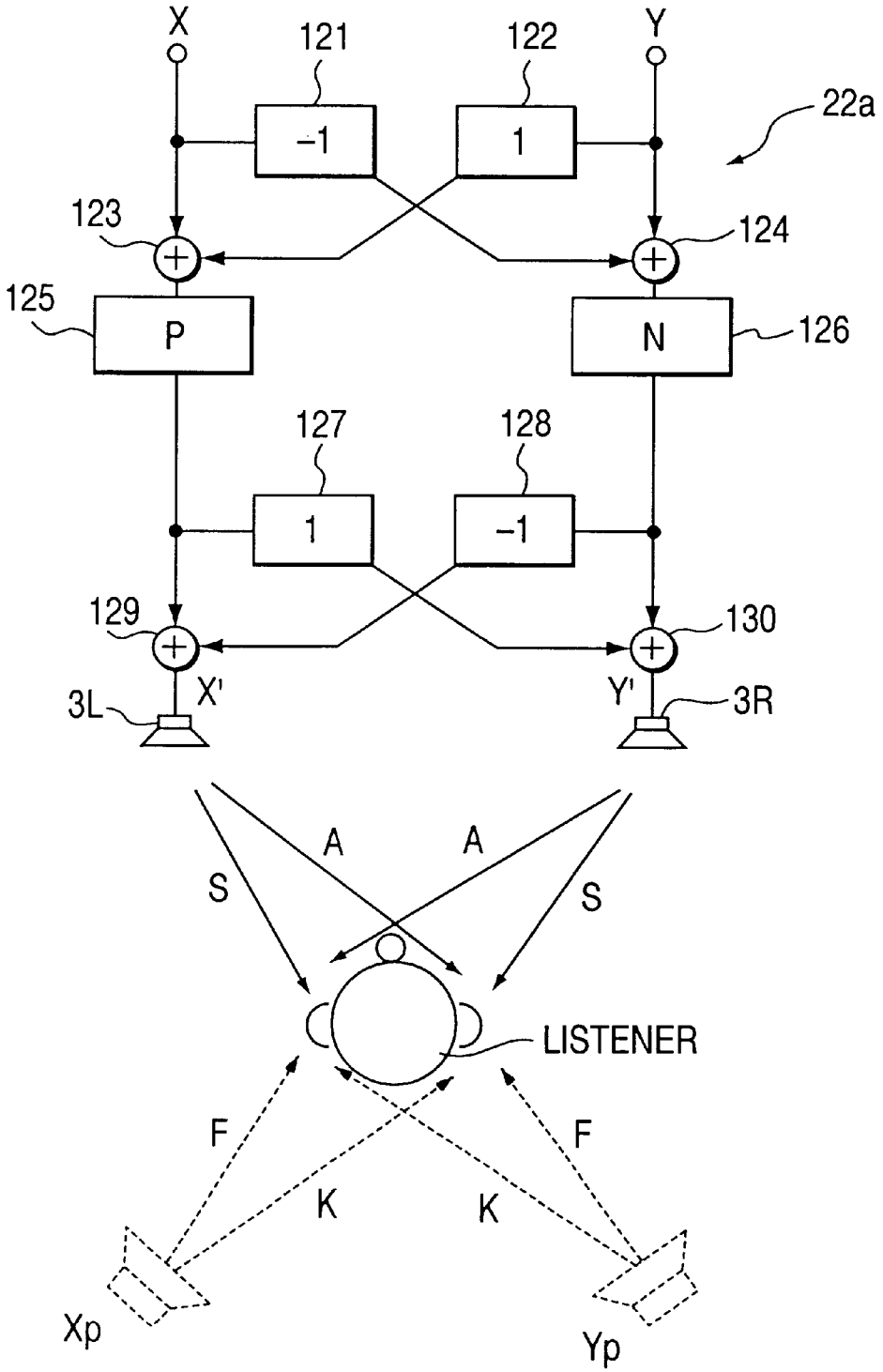
FIG. 6 is a diagram of a portion of the system in FIG. 5 and a listener.

As shown in FIG. 6, the shuffler filter 22*a* includes an inverter 121, a buffer 122, adders 123 and 124, filtering elements 125 and 126, a buffer 127, an inverter 128, and adders 129 and 130. The left surround signal SL is fed to the inverter 121 and the adder 123. The inverter 121 multiplies the left surround signal SL by "−1". In other words, the device 121 inverts the left surround signal SL. The inverter 121 outputs the inversion-resultant signal to the adder 124. The right surround signal SR is fed to the buffer 122 and the adder 124. The buffer 122 transmits the right surround signal SR to the adder 123 without processing the right surround signal SR. The adder 123 adds the left surround signal SL and the right surround signal SR, outputting a signal representing the sum of the left surround signal SL and the right surround signal SR. The adder 124 adds the right surround signal SR and the inversion of the left surround signal SL, outputting a signal representing a difference between the left surround signal SL and the right surround signal SR.

The output signal of the adder 123 is fed to the filtering element 125, being filtered thereby according to a filter coefficient "P". The output signal of the filtering element 125 is fed to the buffer 127 and the adder 129. The buffer 127 transmits the output signal of the filtering element 125 to the adder 130 without processing the output signal of the filtering element 125. The output signal of the adder 124 is fed to the filtering element 126, being filtered thereby according to a filter coefficient "N". The output signal of the filtering element 126 is fed to the inverter 128 and the adder 130. The inverter 128 multiplies the output signal of the filtering element 126 by "−1". In other words, the device 128 inverts the output signal of the filtering element 126. The inverter 128 outputs the inversion-resultant signal to the adder 129. The adder 129 adds the output signal of the filtering element 125 and the inversion of the output signal of the filtering element 126, outputting a signal representing a difference between the output signal of the filtering element 125 and the output signal of the filtering element 126. The output signal of the adder 129 is fed to the left loudspeaker 3L. The adder 130 adds the output signal of the filtering element 125 and the output signal of the filtering element 126, outputting a signal representing a sum of the output signal of the filtering element 125 and the output signal of the filtering element 126. The output signal of the adder 130 is fed to the right loudspeaker 3R.

The filter coefficients "P" and "N" are determined as follows.

The equations (5) and (6) are changed to the following equations.

$$X'=\{(X-Y)/(S-A)\}+Y' \quad (11)$$

$$Y'=\{(X+Y)/(S+A)\}-X' \quad (12)$$

The equations (11) and (12) are changed to the following equations.

$$2X'=\{(X-Y)/(S-A)\}+\{(X+Y)/(S+A)\} \quad (13)$$

$$2Y'=\{(X+Y)/(S+A)\}-\{(X-Y)/(S-A)\} \quad (14)$$

The filter design of FIG. 6 provides the following equations.

$$X'=N(X-Y)+P(X+Y) \quad (15)$$

$$Y'=P(X+Y)-N(X-Y) \quad (16)$$

The equations (15) and (16) are compared with the equations (13) and (14), and hence the following relations are available while constants are disregarded.

$$P=1/(S+A) \quad (17)$$

$$N=1/(S-A) \quad (18)$$

When the filter coefficients "P" and "N" expressed by the relations (17) and (18) are substituted for the values "P" and "N" in the equations (15) and (16), the following equations are provided.

$$X'=2(SX-AY)/(S^2-A^2) \quad (19)$$

$$Y'=2(SY-AX)/(S^2-A^2) \quad (20)$$

Now, the filter coefficients "P" and "N" are set as follows.

$$P=(F+K)/(S+A) \quad (21)$$

$$N=(F-K)/(S-A) \quad (22)$$

where "F" denotes the transfer function of a sound path from a desired position Xp of a localized rear left sound image to the left ear of the listener, and also the transfer function of a sound path from a desired position Yp of a localized rear right sound image to the right ear of the listener, and "K" denotes the transfer function of a sound path from the desired position Xp to the right ear of the listener and the transfer function of a sound path from the desired position Yp to the left ear of the listener. When the filter coefficients "P" and "N" expressed by the relations (21) and (22) are substituted for the values "P" and "N" in the equations (15) and (16), the following equations are provided.

$$X'=2(SFX+SKY-AFY-AKX)/(S^2-A^2) \quad (23)$$

$$Y'=2(SFY+SKX-AFX-AKY)/(S^2-A^2) \quad (24)$$

When "X=x" and "Y=0" are substituted for the values "X" and "Y" in the equations (23) and (24), the following equations are available.

$$X'=\{2(SF-AK)/(S^2-A^2)\}\cdot x \quad (25)$$

$$Y'=\{2(SK-AF)/(S^2-A^2)\}\cdot x \quad (26)$$

On the other hand, when "X=0" and "Y=y" are substituted for the values "X" and "Y" in the equations (23) and (24), the following equations are available.

$$X'=\{2(SK-AF)/(S^2-A^2)\}\cdot y \quad (27)$$

$$Y'=\{2(SF-AK)/(S^2-A^2)\}\cdot y \quad (28)$$

The equations (25), (26), (27), and (28) indicate that sound images are localized at rear positions symmetrical with respect to the listener.

With reference back to FIG. 5, the left signal L is transmitted from the AC-3 decoder 1 to the left loudspeaker 3L via the adders 22*c* and 22*e* in the signal processing circuit 2A. The left signal L is converted into corresponding sound by the left loudspeaker 3L. The right signal R is transmitted from the AC-3 decoder 1 to the right loudspeaker 3R via the adders 22*d* and 22*f* in the signal processing circuit 2A. The right signal R is converted into corresponding sound by the right loudspeaker 3R. The center signal C is fed from the AC-3 decoder 1 to the attenuator 22*b* in the signal processing circuit 2A, being therefore attenuated by 3 dB. The attenuation-resultant center signal C is equally distributed to the loudspeakers 3L and 3R via the adders 22*c*, 22*d*, 22*e*, and 22*f* in the signal processing circuit 2A. The attenuation-resultant center signal C is equally converted into corresponding sound by the loudspeakers 3L and 3R. The left surround signal SL and the right surround signal SR are fed from the AC-3 decoder 1 to the shuffler filter 22*a* in the signal processing circuit 2A. The shuffler filter 22*a* converts the left surround signal SL and the right surround signal SR into a left-channel signal and a right-channel signal by a shuffling process of localizing rear sound images on the left side and the right side of the listener. The shuffler filter 22*a* outputs the left-channel signal to the adder 22*e*. The shuffler filter 22*a* outputs the right-channel signal to the adder 22*f*. The left-channel output signal of the shuffler filter 22*a* is added to the left signal L and the attenuation-resultant center signal C by the adder 22*e*. The addition-resultant signal is transmitted to the left loudspeaker 3L before being converted thereby into corresponding sound. The right-channel output signal of the shuffler filter 22*a* is added to the right signal R and the attenuation-resultant center signal C by the adder 22*f*. The addition-resultant signal is transmitted to the right loudspeaker 3R before being converted thereby into corresponding sound.

As shown in FIG. 4, in addition to real loudspeakers formed by the front left loudspeaker 3L and the front right loudspeaker 3R, there are provided three virtual loudspeakers, that is, a virtual front center loudspeaker 115, a virtual rear left loudspeaker 116, and a virtual rear right loudspeaker 117. The listener can feel as if sound represented by the center signal C, sound represented by the left surround signal SL, and sound represented by the right surround signal SR are generated by the virtual front center loudspeaker 115, the virtual rear left loudspeaker 116, and the virtual rear right loudspeaker 117, respectively.

Third Embodiment

Figure 7:
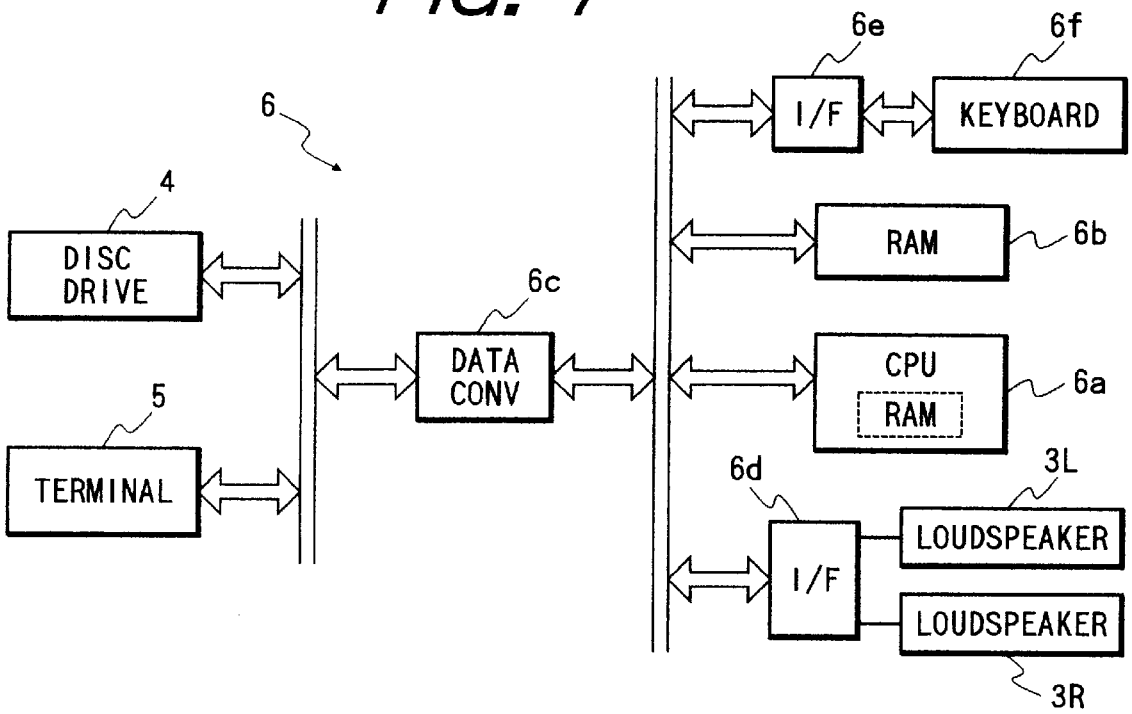
FIG. 7 is a block diagram of a personal computer according to a third embodiment of this invention.

With reference to FIG. 7, a personal computer 6 includes a disc drive 4, a network terminal 5, a CPU 6*a*, a RAM 6*b*, a data converter 6*c*, an audio interface 6*d*, a keyboard interface 6*e*, and a keyboard 6*f*. The disc drive 4, the network terminal 5, and the data converter 6*c* are connected via a bus. The CPU 6*a*, the RAM 6*b*, the data converter 6*c*, the audio interface 6*d*, and the keyboard interface 6*e* are connected via a bus. The CPU 6*a* includes a RAM. The keyboard 6*f* is connected to the keyboard interface 6*e*. The audio interface 6*d* is connected to loudspeakers 3L and 3R. The network terminal 5 is connected to a communication network such as the Internet. The network terminal 5 transmits and receives data to and from the communication network according to a known protocol such as "TCP/IP".

An AC-3 surround signal processing program is stored in a disc. When the disc is placed in the disc drive 4, the personal computer 6 can read out the AC-3 surround signal processing program from the disc via the disc drive 4.

Figure 8:
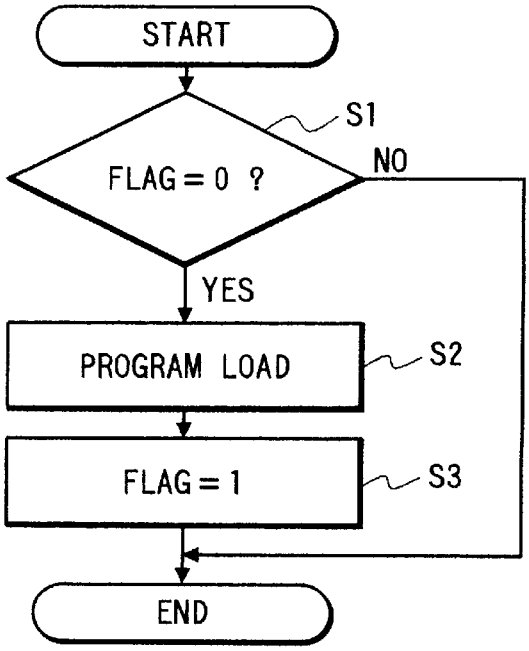
FIG. 8 is a flowchart of a first mode of operation of the personal computer in FIG. 7.

FIG. 8 is a flowchart of a first mode of operation of the personal computer 6 which is started when a program load command is inputted via the keyboard 6*f*. With reference to FIG. 8, a first step S1 decides whether or not a program load flag is "0". It should be noted that the program load flag is initially set to "0". The program load flag is designed to indicate whether or not program load is completed. When the program load flag is "0", that is, when the program load is not completed, the operation of the personal computer 6 proceeds from the step S1 to a step 32. Otherwise, the operation of the personal computer 6 exits from the step S1, and then the operation of the personal computer 6 ends.

The step S2 activates the disc drive 4, and reads out the AC-3 surround signal processing program from a disc in the disc drive 4. The step S2 transmits the AC-3 surround signal processing program from the disc drive 4 to the RAM within the CPU 6*a* via the data converter 6*c*.

A step S3 following the step S2 sets the program load flag to "1" so that the program load flag will indicate the completion of the program load. After the step S3, the operation of the personal computer 6 ends.

There is a disc as a surround source which stores a digital audio surround signal resulting from multiplexing 5-channel signals (that is, a left signal L, a right signal R, a center signal C, a left surround signal SL, and a right surround signal SR). When the disc is placed in the disc drive 4, the personal computer 6 can read out the digital audio surround signal from the disc via the disc drive 4.

Figure 9:
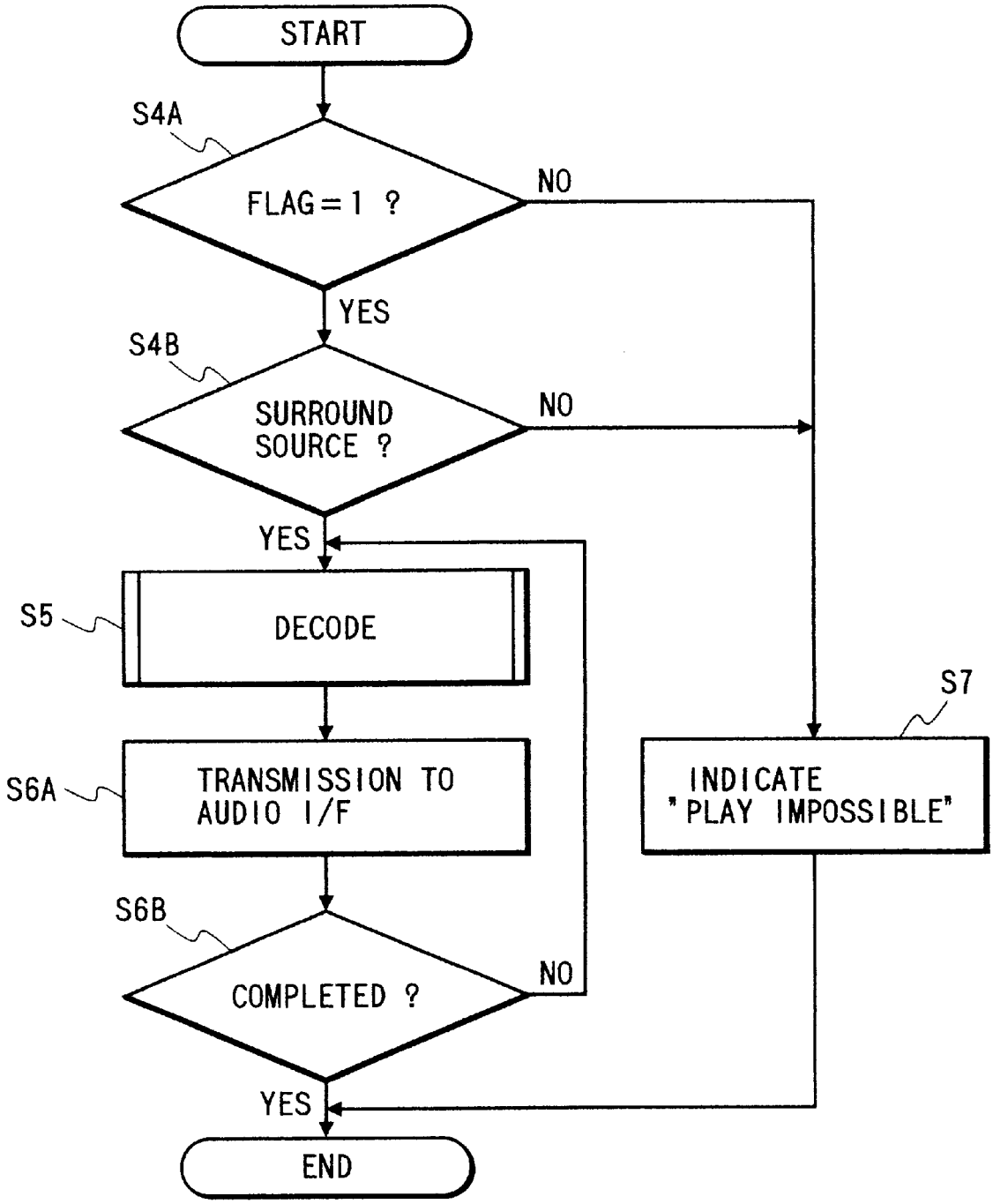
FIG. 9 is a flowchart of a second mode of operation of the personal computer in FIG. 7.

FIG. 9 is a flowchart of a second mode of operation of the personal computer 6 which is started when a disc play command is inputted via the keyboard 6*f*. With reference to FIG. 9, a first step S4A decides whether or not the program load flag is "1". When the program load flag is "1", that is, when the program load is completed, the operation of the personal computer 6 proceeds from the step S4A to a step S4B. Otherwise, the operation of the personal computer 6 proceeds from the step S4A to a step S7.

The step S4B activates the disc drive 4, and accesses a first track of a disc in the disc drive 4 to read out subcode information therefrom. The subcode information represents the type of the disc. The step S4B decides whether or not the type of the disc indicates a surround source. When the type of the disc indicates a surround source, the operation of the personal computer 6 proceeds from the step S4B to a block S5. Otherwise, the operation of the personal computer 6 proceeds from the step S4B to the step S7.

The block S5 activates the disc drive 4, and reads out data from a next track of the disc therein. The block S5 decodes the readout data into 5-channel data pieces, and converts the 5-channel data pieces to 2-channel data pieces according to the AC-3 surround signal processing program.

A step S6A following the bock S5 transmits the 2-channel data pieces to the audio interface 6*d*. The audio interface 6*d* converts the 2-channel data pieces to corresponding 2-channel analog signals respectively, and feeds the 2-channel analog signals to the loudspeakers 3L and 3R respectively.

A step S6B subsequent to the step S6A decides whether or not a final track of the disc in the disc drive 4 has been accessed. When the final track of the disc in the disc drive 4 has not yet been accessed, the operation of the personal computer 6 returns from the step S6B to the block S5. When the final track of the disc in the disc drive 4 has been accessed, the operation of the personal computer 6 exits from the step S6B and then ends.

The step S7 controls a display (not shown) to indicate "play impossible" on the display. After the step S7, the operation of the personal computer 6 ends.

Figure 10:
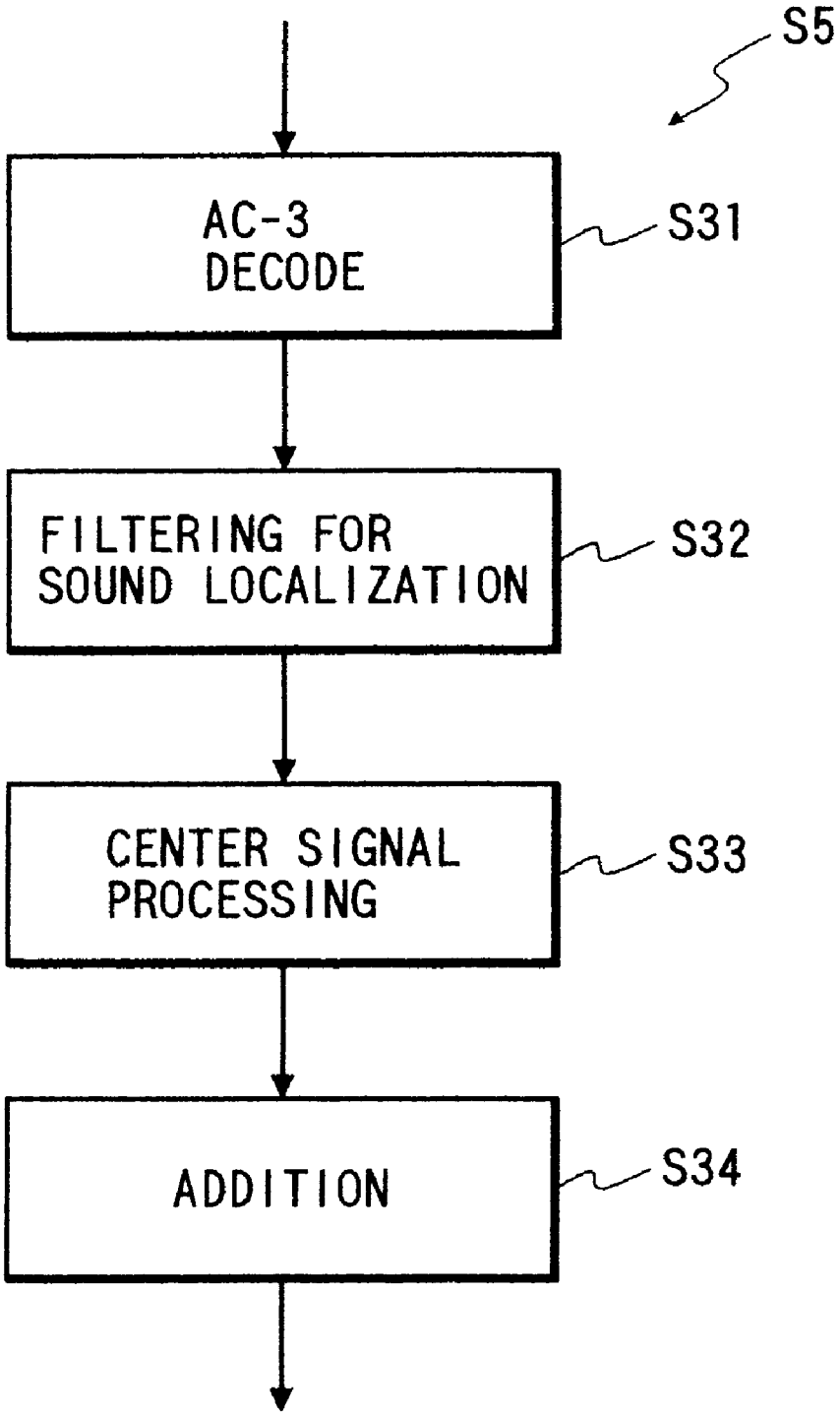
FIG. 10 is a flow diagram of the details of a block in FIG. 9.

As shown in FIG. 10, the block S5 has a sequence of steps S31, S32, S33, and S34. The first step S31 in the block S5 decodes the readout data into 5-channel data pieces in a known "AC-3" based way given by the AC-3 surround signal processing program. The 5-channel data pieces are a left data piece, a right data piece, a center data piece, a left surround data piece, and a right surround data piece. The step S31 corresponds to the AC-3 decoder 1 of FIG. 1.

According to the AC-3 surround signal processing program, the step S32 following the step S31 subjects the left surround data piece and the right surround data piece to filtering processes of localizing sound images at rear positions symmetrical with respect to the listener. The step S32 corresponds to the filters 21*a*, 21*b*, 21*c*, and 21*d* of FIG. 1.

According to the AC-3 surround signal processing program, the step S33 subsequent to the step S32 subjects the center data piece to processing which corresponds to attenuation by 3 dB. The step S33 adds the left data piece and the attenuation-resultant center data piece. The step S33 adds the right data piece and the attenuation-resultant center data piece. The step S33 corresponds to the attenuator 21*e* and the adders 21*f* and 21*g* of FIG. 1.

According to the AC-3 surround signal processing program, the step S34 following the step S33 adds and combines the data pieces generated by the step S32 and the data pieces generated by the step S33 into the 2-channel data pieces. The step S34 corresponds to the adders 21*h* and 21*i* of FIG. 1.

Fourth Embodiment

A fourth embodiment of this invention is similar to the third embodiment thereof except for design changes indicated hereinafter.

Figure 11:
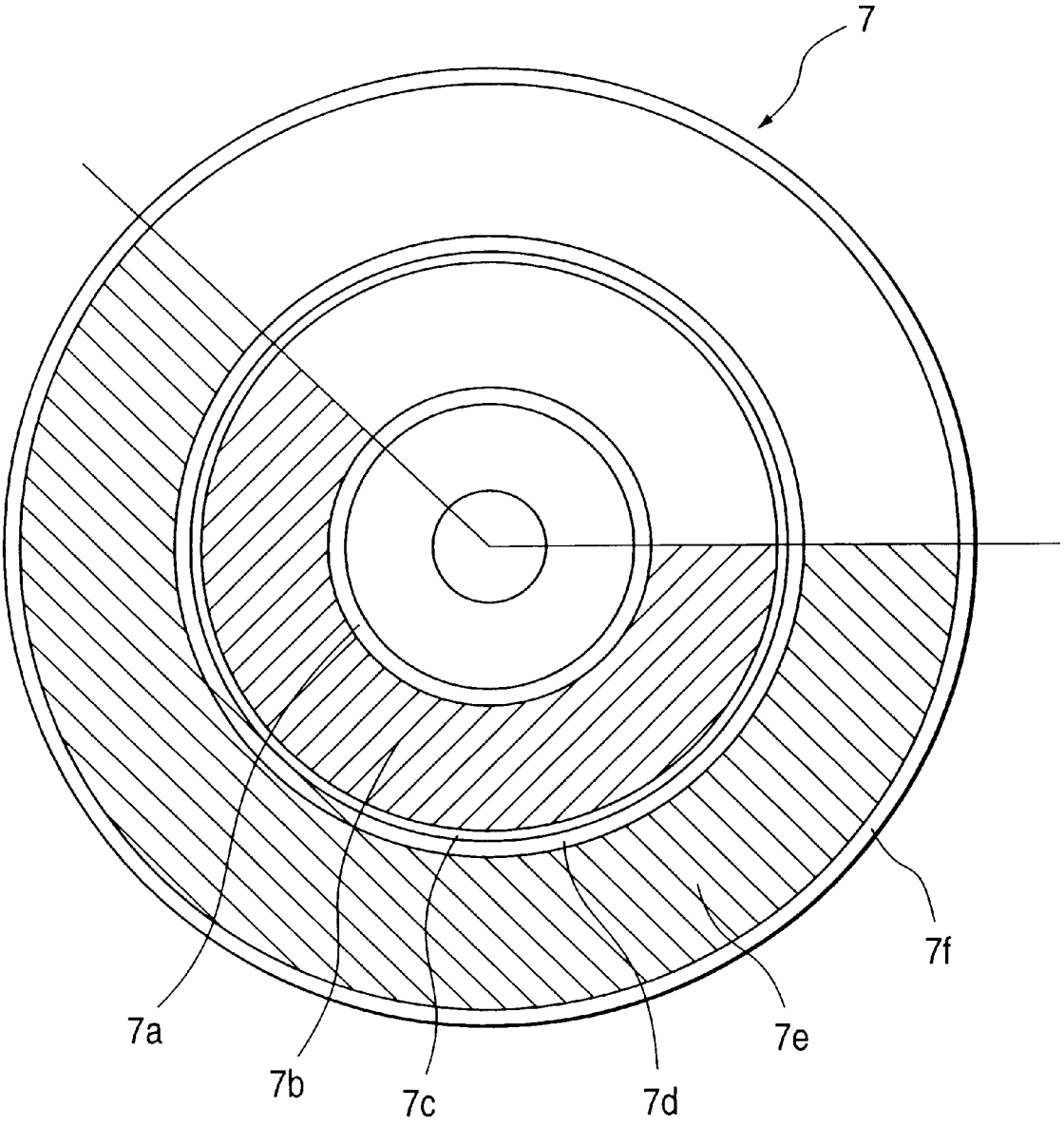
FIG. 11 is a diagram of an optical recording disc in a fourth embodiment of this invention.

With reference to FIG. 11, a disc 7 is an optical recording medium having a diameter of, for example, 120 mm. The disc 7 is, for example, a CD plus or an enhanced music CD in conformity with known standards.

The disc 7 has a first lead-in area 7*a*, a first data area 7*b*, a first lead-out area 7*c*, a second lead-in area 7*d*, a second data area 7*e*, and a second lead-out area 7*f* which are concentrically arranged in that order as viewed in a radially outward direction.

The first lead-in area 7*a* is a TOC (table of contents) area for storing first TOC information of addresses of data in the first data area 7*b*. Similarly, the second lead-in area 7*d* is a TOC (table of contents) area for storing second TOC information of addresses of data in the second data area 7*e*.

The data in the first data area 7*b* represents the AC-3 surround signal processing program. The first data area 7*b* is divided into a former portion and a latter portion. The AC-3 surround signal processing program is stored in the former portion of the first data area 7*b*. The latter portion of the first data area 7*b* stores test data and information of a correct result of decoding the test data. On the other hand, the data in the second data area 7*e* corresponds to a surround source.

When the disc 7 is placed in the disc drive 4 (see FIG. 7), the personal computer 6 (see FIG. 7) can read out the AC-3 surround signal processing program and the surround source from the disc 7 via the disc drive 4.

Figure 12:
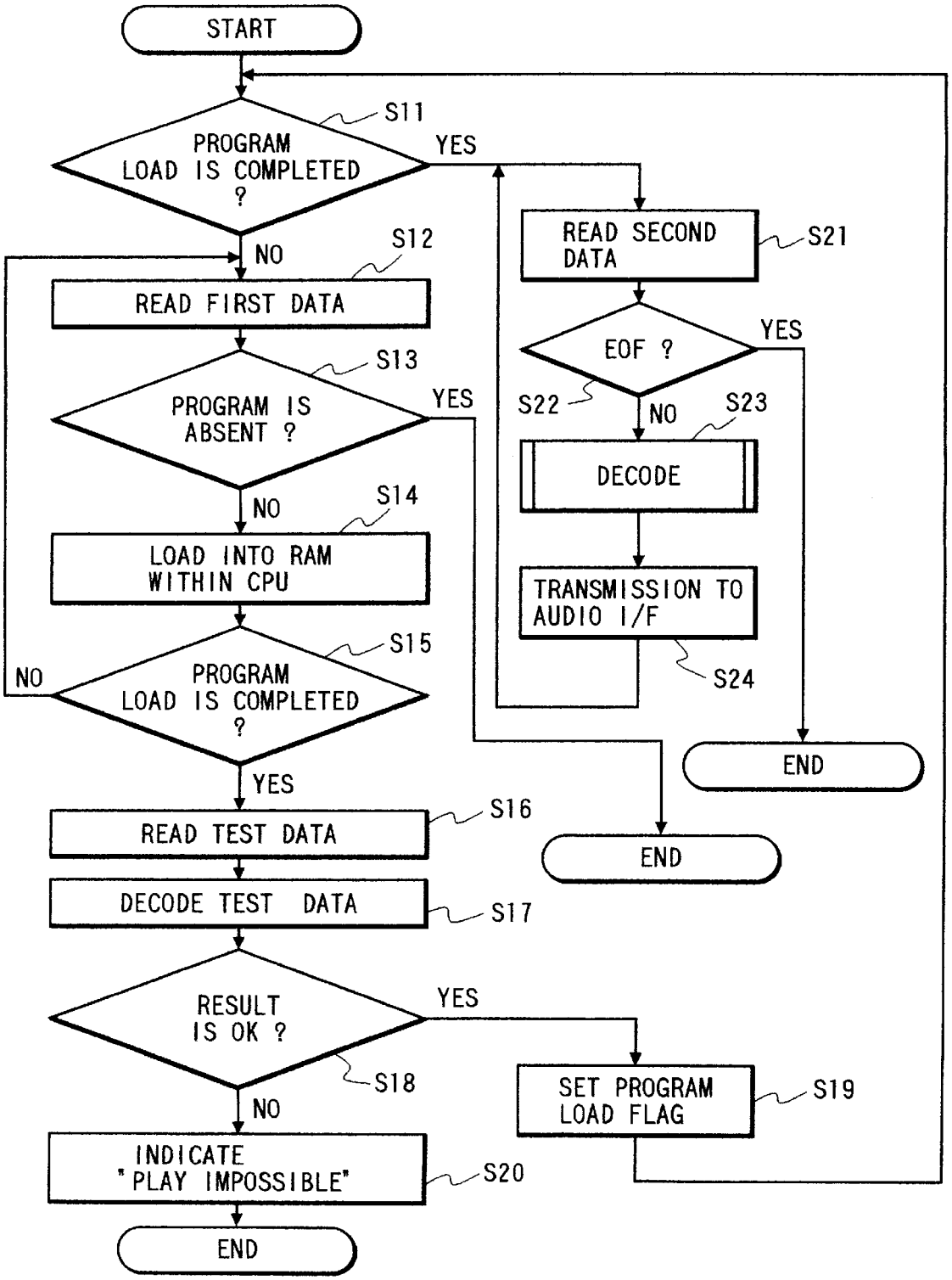
FIG. 12 is a flowchart of operation of a personal computer in the fourth embodiment of this invention.

FIG. 12 is a flowchart of a mode of operation of the personal computer 6 (see FIG. 7) which is started when the disc 7 is placed in the disc drive 4 (see FIG. 7) and a disc play command is inputted via the keyboard 6*f* (see FIG. 7). With reference to FIG. 12, a first step S11 decides whether or not a program load flag is "1", that is, whether or not program load is completed. It should be noted that the program load flag is initially set to "0". When the program load flag is "1", that is, when the program load is completed, the operation of the personal computer 7 proceeds from the step S11 to a step S21. Otherwise, the operation of the personal computer 6 proceeds from the step S11 to a step S12.

The step S12 accesses the first lead-in area 7*a*, and reads out the first TOC information therefrom. The step S12 accesses the first data area 7*b* according to the first TOC information, and reads out the data (the AC-3 surround signal processing program) therefrom.

A step S13 following the step S12 decides whether the AC-3 surround signal processing program is present in or absent from the data read out from the first data area 7*b*. When the AC-3 surround signal processing program is absent, the operation of the personal computer 6 exits from the step S13 and then ends. When the AC-3 surround signal processing program is present, the operation of the personal computer 6 proceeds from the step S13 to a step S14.

The step S14 loads the RAM within the CPU 6*a* (see FIG. 7) with the AC-3 surround signal processing program.

A step S15 subsequent to the step S14 decides whether or not the whole of the AC-3 surround signal processing program has been loaded into the RAM within the CPU 6*a*. When the whole of the AC-3 surround signal processing program has been loaded, the operation of the personal computer 6 proceeds from the step S15 to a step S16. Otherwise, the operation of the personal computer 6 returns from the step S15 to the step S12.

The step S16 accesses the first data area 7*b*, and reads out the test data and the correct-decoding-result information therefrom. The step S16 transmits the test data and the correct-decoding-result information to the RAM within the CPU 6*a*.

A step S17 following the step S16 decodes the test data according to the AC-3 surround signal processing program.

A step S18 subsequent to the step S17 decides whether or not the result of decoding by the step S17 agrees with the correct-decoding-result information. When the result of decoding by the step S17 agrees with the correct-decoding-result information, the operation of the personal computer 6 proceeds from the step S18 to a step S19. Otherwise, the operation of the personal computer 6 proceeds from the step S18 to a step S20.

The step S19 sets the program load flag to "1". After the step S19, the program returns to the step S11.

The step S20 controls a display (not shown) to indicate "play impossible" on the display. After the step S20, the operation of the personal computer 6 ends.

The step S21 accesses the second lead-in area 7*e*, and reads out the second TOC information therefrom. The step S21 accesses the second data area 7*e* according to the second TOC information, and reads out the data (the surround source) therefrom.

A step S22 subsequent to the step S21 decides whether or not an EOF (end of file) signal appears in the data read out from the second data area 7*e*. When the EOF signal appears, the operation of the personal computer 6 exits from the step S22 and then ends. Otherwise, the operation of the personal computer 6 proceeds from the step S22 to a block S23.

The block S23 decodes the data read out by the step S21 into 5-channel data pieces, and converts the 5-channel data pieces to 2-channel data pieces according to the AC-3 surround signal processing program. The block S23 corresponds to the block 5 in FIGS. 9 and 10.

A step S24 following the bock S23 transmits the 2-channel data pieces to the audio interface 6*d* (see FIG. 7). The audio interface 6*d* converts the 2-channel data pieces to corresponding 2-channel analog signals respectively, and feeds the 2-channel analog signals to the loudspeakers 3L and 3R (see FIG. 7) respectively.

Fifth Embodiment

A fifth embodiment of this invention is similar to the third embodiment thereof except for design changes indicated hereinafter.

Figure 13:
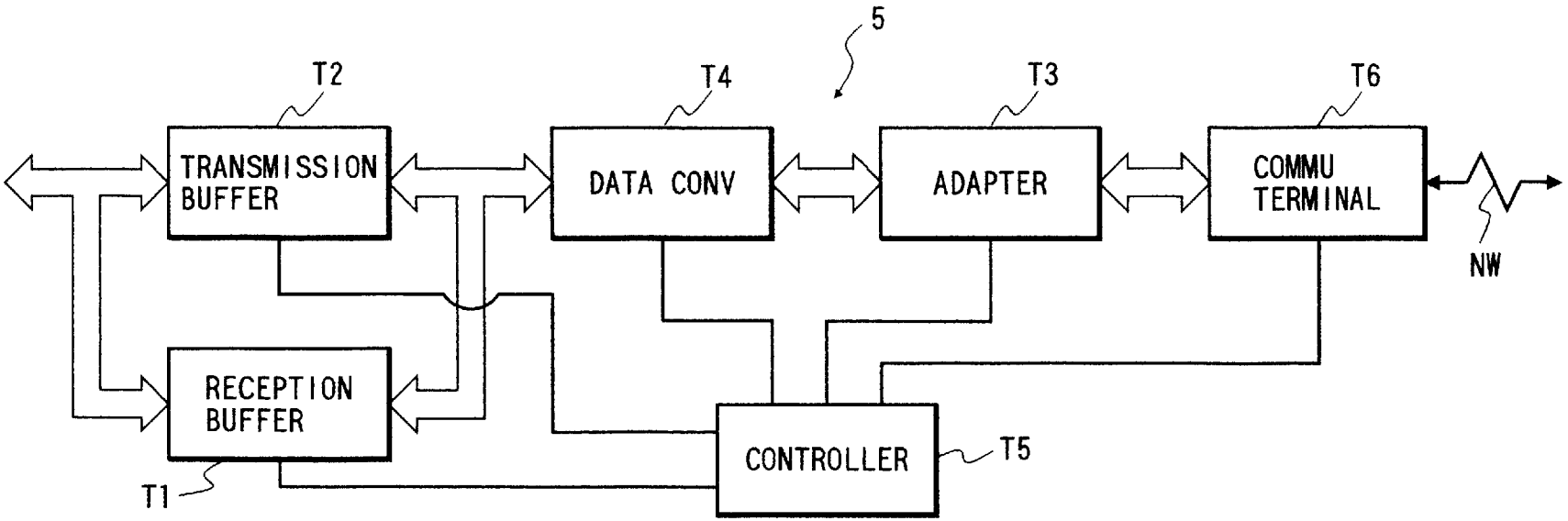
FIG. 13 is a block diagram of a network terminal in a fifth embodiment of this invention.

With reference to FIG. 13, the network terminal 5 (see FIG. 7) includes a reception buffer T1, a transmission buffer T2, an adapter T3, a data converter T4, a controller T5, and a communication terminal T6. The reception buffer T1 and the transmission buffer T2 are connected between the data converter T4 and the bus within the personal computer 6 (see FIG. 7). The data converter T4 is connected via the adapter T3 to the communication terminal T6. The communication terminal T6 is connected to the communication network NW such as the Internet or a CATV network. The controller T5 is connected to the reception buffer T1, the transmission buffer T2, the adapter T3, the data converter T4, and the communication terminal T6. The controller T5 serves to control the reception buffer T1, the transmission buffer T2, the adapter T3, the data converter T4, and the communication terminal T6.

The controller T5 includes a microcomputer, a digital signal processor, or a similar device which has a combination of an input/output port, a processing section, a ROM, and a RAM. The controller T5 operates in accordance with a control program stored in the ROM.

The personal computer 6 (see FIG. 7) can read out an AC-3 surround signal processing program from a disc via the disc drive 4 (see FIG. 7). The personal computer 6 can transmit the AC-3 surround signal processing program to the communication network NW via the network terminal 5.

Figure 14:
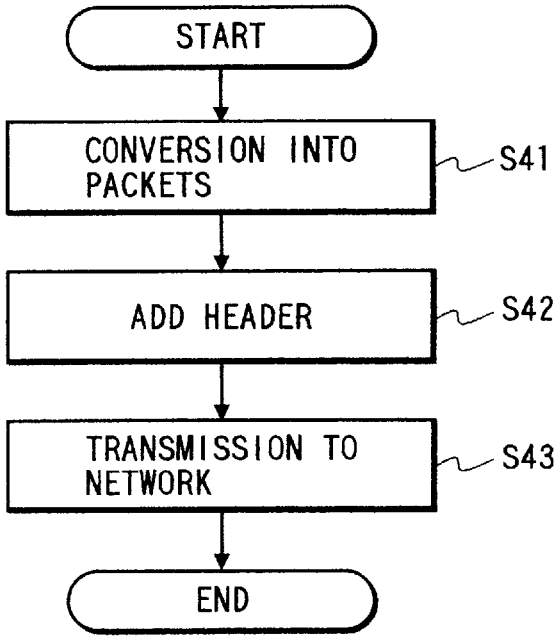
FIG. 14 is a flowchart of a first segment of a program for a controller in FIG. 13.

FIG. 14 is a flowchart of a segment of the control program for the controller T5 which relates to the transmission of an AC-3 surround signal processing program to the communication network NW. With reference to FIG. 14, a first step S41 of the control program segment transmits the AC-3 surround signal processing program to the data converter T4 via the transmission buffer T2. The step S41 controls the data converter T4 so that a bit sequence representing the AC-3 surround signal processing program will be divided into packets having equal sizes.

A step S42 following the step S41 generates a header containing destination information for each of the packets. The step S42 controls the data converter T4 so that the headers will be added to the packets respectively. Accordingly, a stream of the header-added packets is generated.

A step S43 subsequent to the step S42 controls the adapter T3 and the communication terminal T6 so that the stream of the header-added packets will be transmitted from the data converter T4 to the communication network NW via the adapter T3 and the communication terminal T6. The step S43 controls the adapter T3 to execute a communication protocol with the communication opposite party. After the step S43, the control program segment ends.

The personal computer 6 (see FIG. 7) can receive an AC-3 surround signal processing program from the communication network NW via the network terminal 5 (see FIG. 7).

Figure 15:
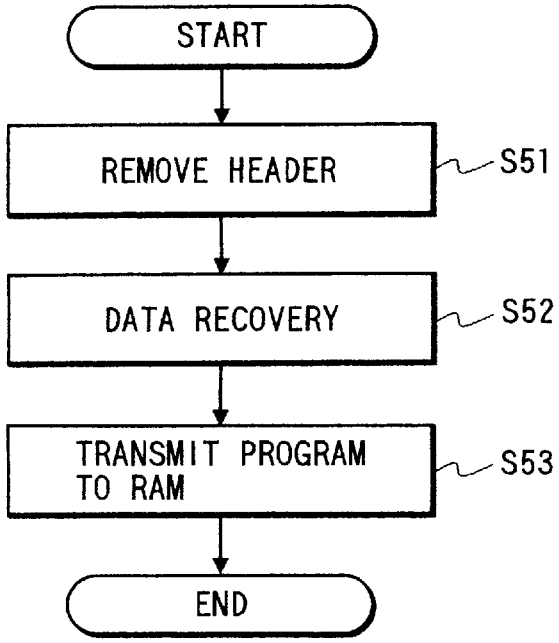
FIG. 15 is a flowchart of a second segment of the program for the controller in FIG. 13.

FIG. 15 is a flowchart of a segment of the control program for the controller T5 which relates to the reception of an AC-3 surround signal processing program from the communication network NW. A stream of header-added packets which represents the AC-3 surround signal processing program is transmitted from the communication network NW to the data converter T4 via the communication terminal T6 and the adapter T3.

With reference to FIG. 15, a first step S51 of the control program segment controls the data converter T4 so that headers will be removed from the packets respectively.

A step S52 following the step S51 controls the data converter T4 so that the header-free packets will be combined into a bit sequence representing the AC-3 surround signal processing program.

A step S53 subsequent to the step S52 controls the data converter T4 and the reception buffer T1 so that the bit sequence of the AC-3 surround signal processing program will be transmitted from the data converter T4 to a RAM within the personal computer 6, for example, the RAM within the CPU 6*a* (see FIG. 7), via the reception buffer T1.

Sixth Embodiment

Figure 16:
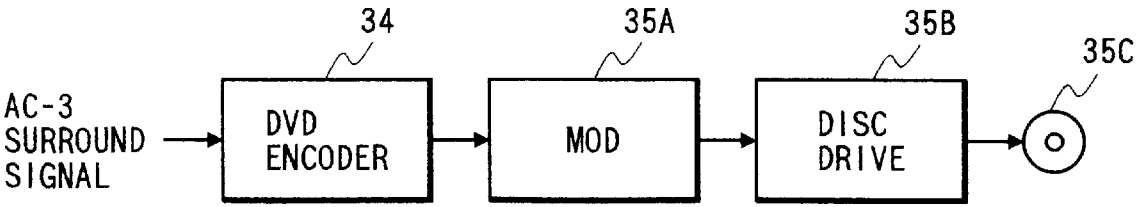
FIG. 16 is a block diagram of a recording apparatus in a sixth embodiment of this invention.

With reference to FIG. 16, a digital AC-3 surround signal is inputted into a DVD (digital video disc) encoder 34. The digital AC-3 surround signal is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium.

Figure 17:
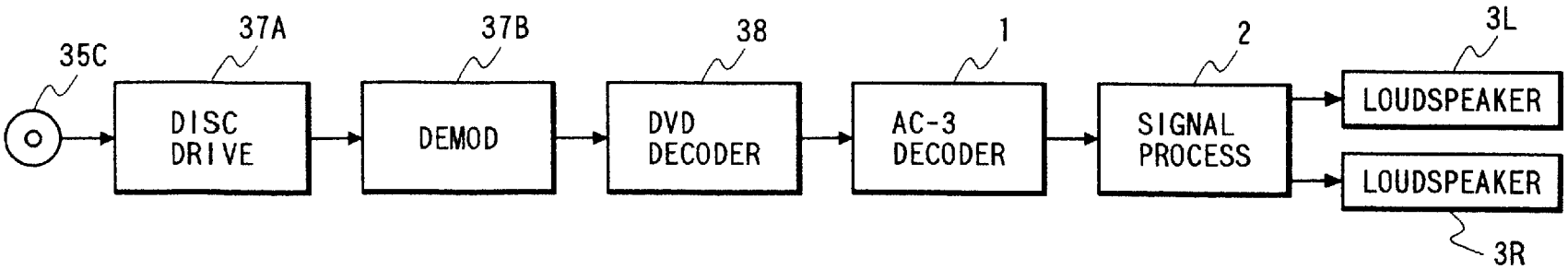
FIG. 17 is a block diagram of a reproducing apparatus in the sixth embodiment of this invention.

With reference to FIG. 17, a disc drive 37A reproduce a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38. The DVD decoder 38 decodes the DVD-format signal into a digital AC-3 surround signal. The DVD decoder 38 outputs the digital AC-3 surround signal to an AC-3 decoder 1 which is the same as that in FIG. 1.

The AC-3 decoder 1 decodes the digital AC-3 surround signal into a left signal L, a right signal R, a center signal C, a left surround signal SL, and a right surround signal SR. The AC-3 decoder 1 outputs the left signal L, the right signal R, the center signal C, the left surround signal SL, and the right surround signal SR to a signal processing circuit 2 which is the same as that in FIG. 1. The signal processing circuit 2 converts the left signal L, the right signal R, the center signal C, the left surround signal SL, and the right surround signal SR into 2-channel signals. The signal processing circuit 2 outputs the 2-channel signals to loudspeakers 3L and 3R respectively.

Seventh Embodiment

Figure 18:
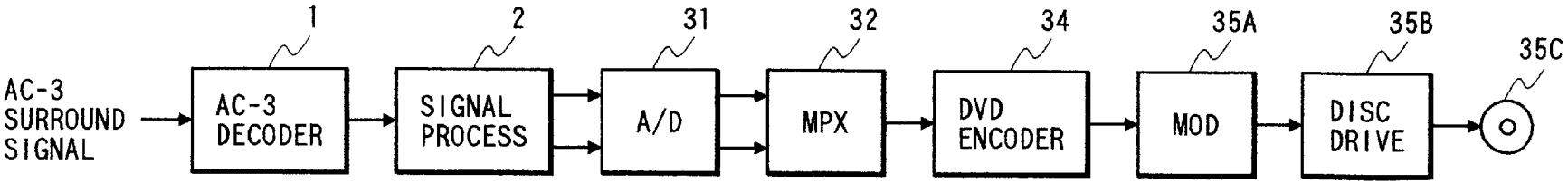
FIG. 18 is a block diagram of a recording apparatus in a seventh embodiment of this invention.

With reference to FIG. 18, a digital AC-3 surround signal is inputted into an AC-3 decoder 1 which is the same as that in FIG. 1. The AC-3 decoder 1 decodes the digital AC-3 surround signal into a left signal L, a right signal R, a center signal C, a left surround signal SL, and a right surround signal SR. The AC-3 decoder 1 outputs the left signal L, the right signal R, the center signal C, the left surround signal SL, and the right surround signal SR to a signal processing circuit 2 which is the same as that in FIG. 1. The signal processing circuit 2 converts the left signal L, the right signal R, the center signal C, the left surround signal SL, and the right surround signal SR into 2-channel analog signals. The signal processing circuit 2 outputs the 2-channel analog signals.

An A/D converter 31 follows the signal processing circuit 2. The A/D converter 31 receives the 2-channel analog signals, and converts the 2-channel analog signals into corresponding 2-channel digital signals. The A/D converter 31 outputs the 2-channel digital signals to a multiplexer 32. The multiplexer 32 combines the 2-channel digital signals into a single digital signal. The multiplexer 32 outputs the single digital signal.

A DVD (digital video disc) encoder 34 follows the multiplexer 32. The output signal of the multiplexer 32 is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium.

Figure 19:
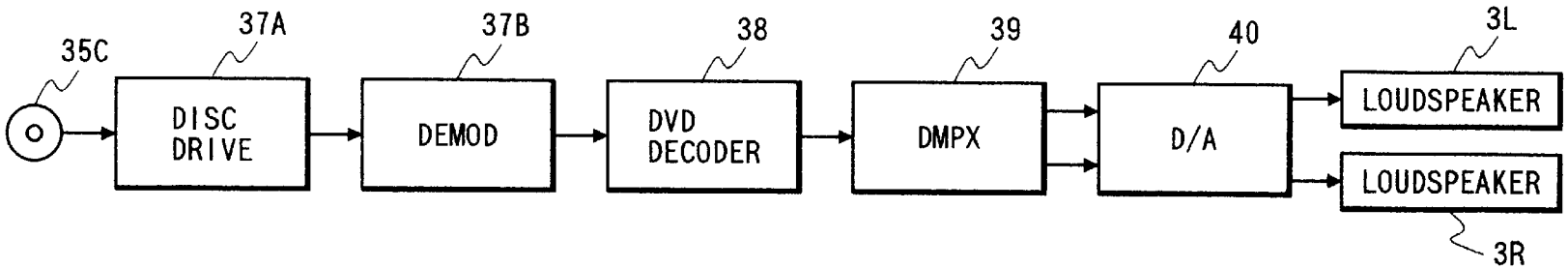
FIG. 19 is a block diagram of a reproducing apparatus in the seventh embodiment of this invention.

With reference to FIG. 19, a disc drive 37A reproduce a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38. The DVD decoder 38 decodes the DVD-format signal into a multiplexing-resultant signal. The DVD decoder 38 outputs the multiplexing-resultant signal to a demultiplexer 39. The demultiplexer 39 separates the multiplexing-resultant signal into 2-channel digital signals. The demultiplexer 39 outputs the 2-channel digital signals to a D/A converter 40. The D/A converter 40 changes the 2-channel digital signals into corresponding 2-channel analog signals. The D/A converter 40 outputs the 2-channel analog signals to loudspeakers 3L and 3R respectively.

Eighth Embodiment

Figure 20:
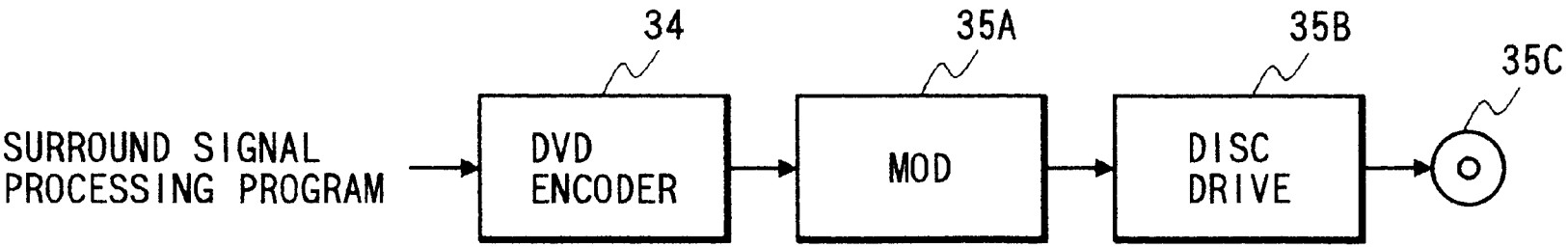
FIG. 20 is a block diagram of a recording apparatus in an eighth embodiment of this invention.

With reference to FIG. 20, a bit sequence representing an AC-3 surround signal processing program is inputted into a DVD (digital video disc) encoder 34. For example, the bit sequence of the AC-3 surround signal processing program is received from a communication network via a personal computer. The bit sequence of the AC-3 surround signal processing program is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium. In this way, information of the AC-3 surround signal processing program is recorded on the recording medium 35C.

Figure 21:
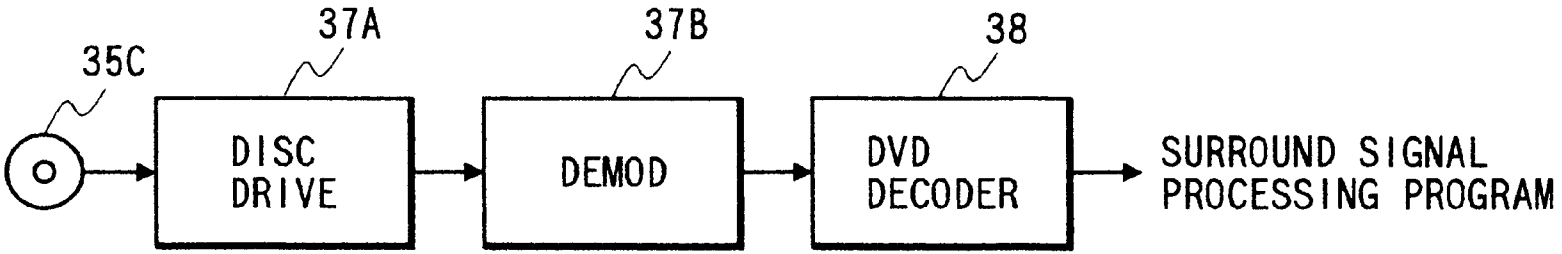
FIG. 21 is a block diagram of a reproducing apparatus in the eighth embodiment of this invention.

With reference to FIG. 21, a disc drive 37A reproduce a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38. The DVD decoder 38 decodes the DVD-format signal into a bit sequence representing an AC-3 surround signal processing program. The DVD decoder 38 outputs the bit sequence of the AC-3 surround signal processing program. The bit sequence of the AC-3 surround signal processing program may be transmitted to a communication network via a personal computer.

Ninth Embodiment

Figure 22:
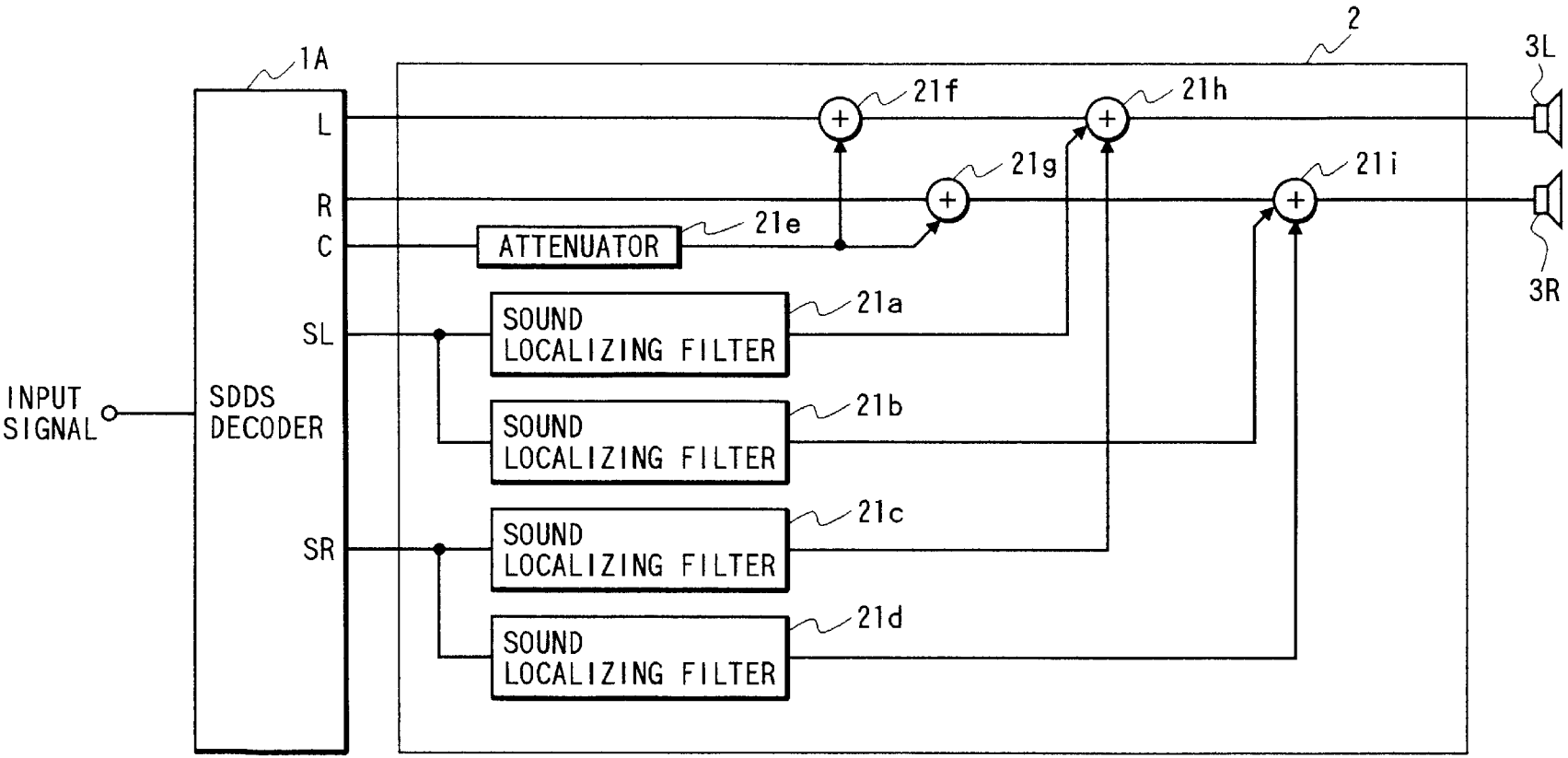
FIG. 22 is a block diagram of a surround signal processing system according to a ninth embodiment of this invention.

FIG. 22 shows a ninth embodiment of this invention which is similar to the first embodiment thereof except for a design change indicated hereinafter. The embodiment of FIG. 22 uses an SDDS (Sony Dynamic Digital Sound) decoder 1A instead of the AC-3 decoder 1 in FIG. 1.

The SDDS decoder 1A receives an input digital audio signal of the SDDS format, and decodes the input digital audio signal into a left signal L, a right signal R, a center signal C, a left surround signal SL, a right surround signal SR, and a subwoofer signal in a know way.

It should be noted that the SDDS decoder 1A may be replaced by a DTS (Digital Theater Sound) decoder.

Tenth Embodiment

Figure 23:
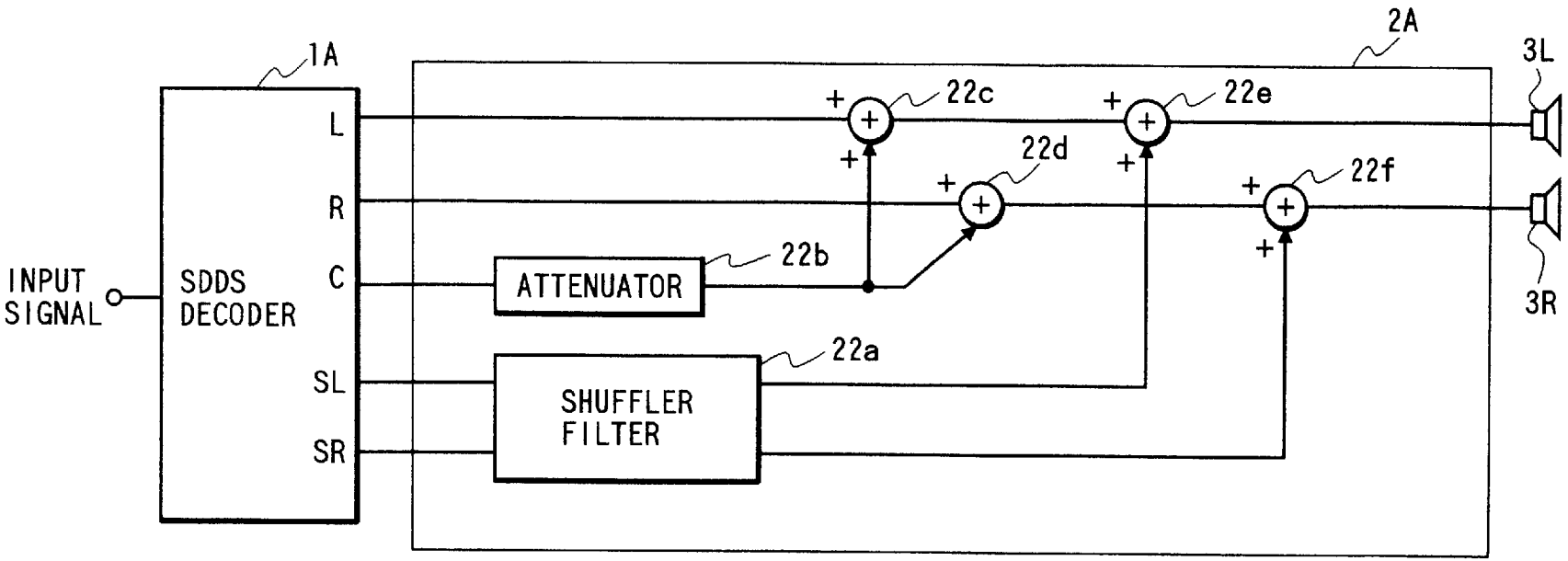
FIG. 23 is a block diagram of a surround signal processing system according to a tenth embodiment of this invention.

FIG. 23 shows a tenth embodiment of this invention which is similar to the second embodiment thereof except for a design change indicated hereinafter. The embodiment of FIG. 23 uses an SDDS (Sony Dynamic Digital Sound) decoder 1A instead of the AC-3 decoder 1 in FIG. 5.

The SDDS decoder 1A receives an input digital audio signal of the SDDS format, and decodes the input digital audio signal into a left signal L, a right signal R, a center signal C, a left surround signal SL, a right surround signal SR, and a subwoofer signal in a know way.

It should be noted that the SDDS decoder 1A may be replaced by a DTS (Digital Theater Sound) decoder.

Eleventh Embodiment

An eleventh embodiment of this invention is similar to the third embodiment thereof except for design changes indicated hereinafter. The eleventh embodiment of this invention handles an SDDS surround signal processing program instead of the AC-3 surround signal processing program.

Figure 24:
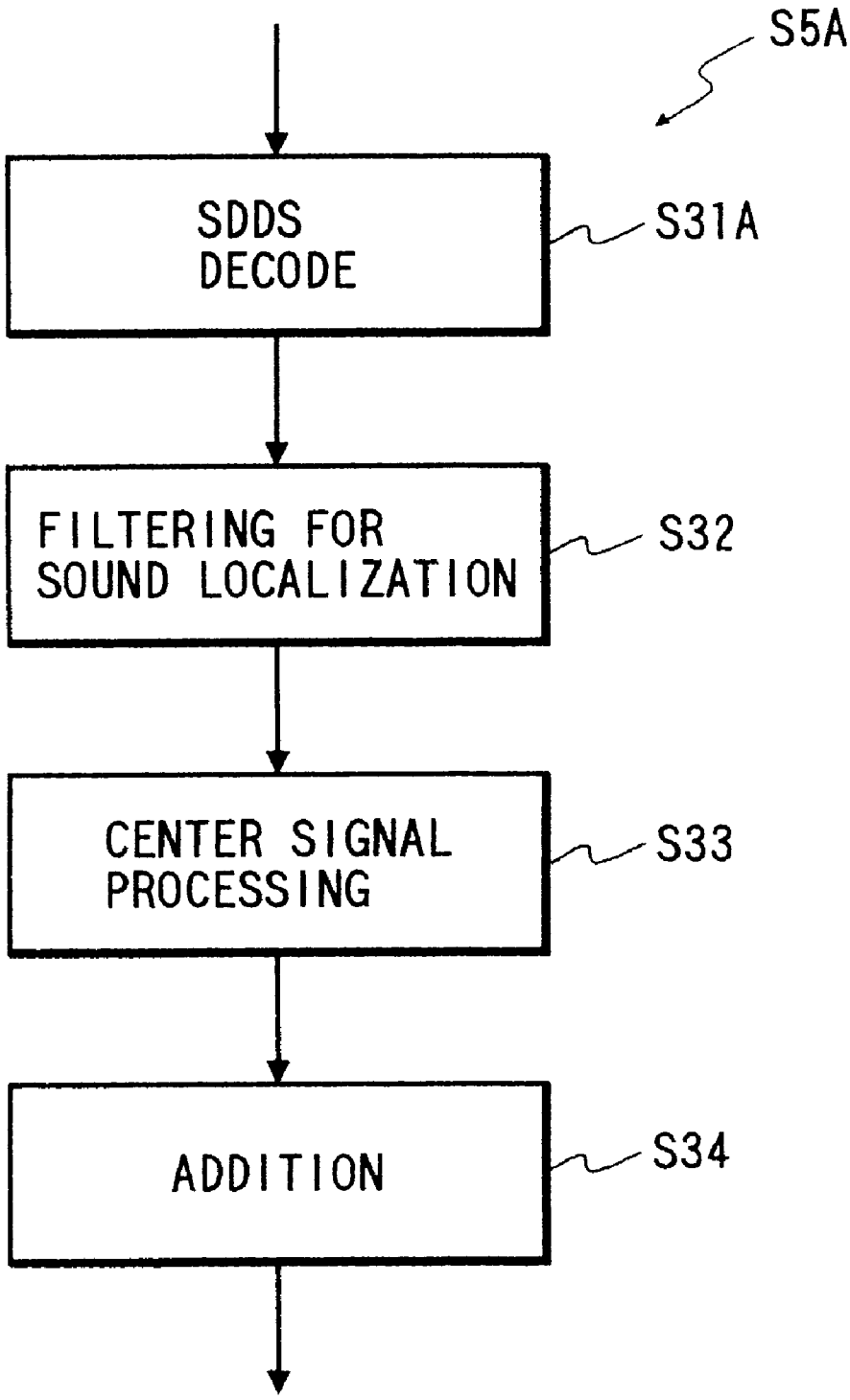
FIG. 24 is a flow diagram of a step block of operation of a personal computer in an eleventh embodiment of this invention.

The eleventh embodiment of this invention uses a block S5A instead of the block S5 in FIG. 9. As shown in FIG. 24, the block S5A has a sequence of steps S31A, S32, S33, and S34. The first step S31A in the block S5A decodes readout data into 5-channel data pieces in a known "SDDS" based way given by the SDDS surround signal processing program. The 5-channel data pieces are a left data piece, a right data piece, a center data piece, a left surround data piece, and a right surround data piece. The step S31A corresponds to the SDDS decoder 1A of FIG. 22.

According to the SDDS surround signal processing program, the step S32 following the step S31A subjects the left surround data piece and the right surround data piece to filtering processes of localizing sound images at rear positions symmetrical with respect to the listener. The step S32 corresponds to the filters 21*a*, 21*b*, 21*c*, and 21*d* of FIG. 22.

According to the SDDS surround signal processing program, the step S33 subsequent to the step S32 subjects the center data piece to processing which corresponds to attenuation by 3 dB. The step S33 adds the left data piece and the attenuation-resultant center data piece. The step S33 adds the right data piece and the attenuation-resultant center data piece. The step S33 corresponds to the attenuator 21*e* and the adders 21*f* and 21*g* of FIG. 22.

According to the SDDS surround signal processing program, the step S34 following the step S33 adds and combines the data pieces generated by the step S32 and the data pieces generated by the step S33 into the 2-channel data pieces. The step S34 corresponds to the adders 21*h* and 21*i* of FIG. 22.

It should be noted that the SDDS surround signal processing program may be replaced by a DTS surround signal processing program.

Twelfth Embodiment

A twelfth embodiment of this invention is similar to the fourth embodiment thereof except for a design change indicated hereinafter. The twelfth embodiment of this invention handles an SDDS surround signal processing program or a DTS surround signal processing program instead of the AC-3 surround signal processing program.

Thirteenth Embodiment

A thirteenth embodiment of this invention is similar to the fifth embodiment thereof except for a design change indicated hereinafter. The thirteenth embodiment of this invention handles an SDDS surround signal processing program or a DTS surround signal processing program instead of the AC-3 surround signal processing program.

Fourteenth Embodiment

A fourteenth embodiment of this invention is similar to the sixth embodiment thereof except for a design change indicated hereinafter. The fourteenth embodiment of this invention handles an SDDS surround signal or a DTS surround signal instead of the AC-3 surround signal.

Fifteenth Embodiment

A fifteenth embodiment of this invention is similar to the seventh embodiment thereof except for a design change indicated hereinafter. The fifteenth embodiment of this invention uses an SDDS decoder or a DTS decoder instead of the AC-3 decoder 1 in FIG. 18. The fifteenth embodiment of this invention handles an SDDS surround signal or a DTS surround signal instead of the AC-3 surround signal.

Sixteenth Embodiment

A sixteenth embodiment of this invention is similar to the eighth embodiment thereof except for a design change indicated hereinafter. The sixteenth embodiment of this invention handles an SDDS surround signal processing program or a DTS surround signal processing program instead of the AC-3 surround signal processing program.

What is claimed is:

1. A surround signal processing system comprising:

first means for receiving a surround signal;

second means for receiving a program of processing the surround signal;

third means for decoding the surround signal received by the first means into multiple-channel signals according to the program received by the second means, the multiple-channel signals including a left surround signal and a right surround signal;

fourth means for converting the multiple-channel signals generated by the third means into two-channel signals according to the program received by the second means;

a pair of loudspeakers; and fifth means for transmitting the two-channel signals generated by the fourth means to the loudspeakers respectively;

wherein the fourth means comprises filtering means for subjecting the left surround signal and the right surround signal generated by the third means to filtering processes according to the program received by the second means to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals; and wherein the filtering means comprises convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

2. A surround signal processing system as recited in claim 1, wherein the second means comprises a disc drive for reading out the program from an information recording disc.

3. A surround signal processing system as recited in claim 1, wherein the second means comprises a terminal device connected to a communication network for receiving the program from the communication network.

4. A method of processing a surround signal, comprising the steps of:

receiving a surround signal;

receiving a program of processing a surround signal;

decoding the received surround signal into multiple-channel signals according to the received program, the multiple-channel signals including a left surround signal and a right surround signal;

converting the multiple-channel signals into two-channel signals according to the received program; and transmitting the two-channel signals to a pair of loudspeakers respectively;

wherein the converting step comprises the filtering step of subjecting the left surround signal and the right surround signal to filtering processes according to the received program to convert the left surround signal and the right surround signal into filtering-resultant signals, the filtering processes being designed to localize sound images at rear positions symmetrical with respect to a listener when a rear loudspeaker is absent and only front loudspeakers are used, and the step of generating the two-channel signals on the basis of the filtering-resultant signals; and wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

5. A method as recited in claim 4, wherein the program receiving step comprises the step of reading out the program from an information recording disc.

6. A method as recited in claim 4, wherein the program receiving step comprises the step of receiving the program from a communication network.

7. An information recording medium which stores a program of processing a surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

8. An information recording medium having a first data recording area and a second data recording area separate from the first data recording area, the first data recording area storing a surround signal, the second data recording area storing a program of processing the surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

9. A transmission system for a surround signal processing program, comprising:

first means for storing a program of processing a surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

a terminal device connected to a communication network; and second means connected to the first means and the terminal device for transmitting the program from the first means to the communication network via the terminal device;

wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker, "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

10. A reception system for a surround signal processing program, comprising:

a terminal device connected to a communication network; and means connected to the terminal device for receiving a program from the communication network via the terminal device;

wherein the program includes a step for decoding a surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

11. A recording apparatus for a surround signal, comprising:

first means for decoding a surround signal into multiple-channel signals, the multiple-channel signals including a left surround signal and a right surround signal;

second means for converting the multiple-channel signals generated by the first means into two-channel signals; and third means for recording the two-channel signals generated by the second means on a recording medium;

wherein the second means comprises filtering means for subjecting the left surround signal and the fight surround signal generated by the first means to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals; and wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

12. A method of recording a surround signal, comprising the steps of:

decoding a surround signal into multiple-channel signals, the multiple-channel signals including a left surround signal and a right surround signal;

converting the multiple-channel signals into two-channel signals; and recording the two-channel signals on a recording medium;

wherein the converting step comprises the filtering step of subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and the step of generating the two-channel signals on the basis of the filtering-resultant signals; and wherein the filtering step provides convolvers for processing the left surround signal and the right surround signal the convolvers having filter coefficients Hl and Hr which are set on the basis of transfer functions as follows:

$$Hl=(SF-AK)(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

13. A recording apparatus for a surround signal processing program, comprising:

first means for encoding a surround signal processing program into an encoding-resultant signal having a form suited for record; and second means for recording the encoding-resultant signal generated by the first means on an information recording medium;

wherein the surround signal processing program includes a step for decoding a surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used; and wherein the filtering step provides convolvers for processing the left surround signal and the right surround signal, the convolvers having filter coefficients Hl and Hr which are set on the basis of transfer functions as follows:

$$Hl=(SF-AK)/(S^2-A^2)$$

$$Hr=(SK-AF)/(S^2-A^2)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

14. A surround signal processing system comprising:

first means for receiving a surround signal;

second means for receiving a program of processing the surround signal;

third means for decoding the surround signal received by the first means into multiple-channel signals according to the program received by the second means, the multiple-channel signals including a left surround signal and a right surround signal;

fourth means for converting the multiple-channel signals generated by the third means into two-channel signals according to the program received by the second means;

a pair of loudspeakers; and fifth means for transmitting the two-channel signals generated by the fourth means to the loudspeakers respectively;

wherein the fourth means comprises filtering means for subjecting the left surround signal and the right surround signal generated by the third means to filtering processes according to the program received by the second means to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals; and wherein the filtering means comprises an adder for adding the left surround signal and the right surround signal into an addition-result signal, a subtracter for generating a subtraction-result signal representative of a difference between the left surround signal and the right surround signal, a first filter for processing the addition-result signal, and a second filter for processing the subtraction-result signal, the first filter and the second filter having filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

15. A surround signal processing system as recited in claim 14, wherein the second means comprises a disc drive for reading out the program from an information recording disc.

16. A surround signal processing system as recited in claim 14, wherein the second means comprises a terminal device connected to a communication network for receiving the program from the communication network.

17. A method of processing a surround signal, comprising the steps of:

receiving a surround signal;

receiving a program of processing a surround signal;

decoding the received surround signal into multiple-channel signals according to the received program, the multiple-channel signals including a left surround signal and a right surround signal;

converting the multiple-channel signals into two-channel signals according to the received program; and transmitting the two-channel signals to a pair of loudspeakers respectively;

wherein the converting step comprises the filtering step of subjecting the left surround signal and the right surround signal to filtering processes according to the received program to convert the left surround signal and the right surround signal into filtering-resultant signals, the filtering processes being designed to localize sound images at rear positions symmetrical with respect to a listener when a rear loudspeaker is absent and only front loudspeakers are used, and the step of generating the two-channel signals on the basis of the filtering-resultant signals; and wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

18. A method as recited in claim 17, wherein the program receiving step comprises the step of reading out the program from an information recording disc.

19. A method as recited in claim 17, wherein the program receiving step comprises the step of receiving the program from a communication network.

20. An information recording medium which stores a program of processing a surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

21. An information recording medium having a first data recording area and a second data recording area separate from the first data recording area the first data recording area storing a surround signal, the second data recording area storing a program of processing the surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

22. A transmission system for a surround signal processing program, comprising:

first means for storing a program of processing a surround signal, the program including a step for decoding the surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

a terminal device connected to a communication network; and second means connected to the first means and the terminal device for transmitting the program from the first means to the communication network via the terminal device;

wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

23. A reception system for a surround signal processing program, comprising:

a terminal device connected to a communication network; and means connected to the terminal device for receiving a program from the communication network via the terminal device;

wherein the program includes a step for decoding a surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used;

wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

24. A recording apparatus for a surround signal, comprising:

first means for decoding a surround signal into multiple-channel signals, the multiple-channel signals including a left surround signal and a right surround signal;

second means for converting the multiple-channel signals generated by the first means into two-channel signals; and third means for recording the two-channel signals generated by the second means on a recording medium;

wherein the second means comprises filtering means for subjecting the left surround signal and the right surround signal generated by the first means to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals;

wherein the filtering means comprises an adder for adding the left surround signal and the right surround signal into an addition-result signal, a subtracter for generating a subtraction-result signal representative of a difference between the left surround signal and the right surround signal, a first filter for processing the addition-result signal, and a second filter for processing the subtraction-result signal, the first filter and the second filter having filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

25. A method of recording a surround signal, comprising the steps of:

decoding a surround signal into multiple-channel signals, the multiple-channel signals including a left surround signal and a right surround signal;

converting the multiple-channel signals into two-channel signals; and recording the two-channel signals on a recording medium;

wherein the second means comprises filtering means for subjecting the left surround signal and the right surround signal generated by the first means to filtering processes to convert the left surround signal and the right surround signal into filtering-resultant signals, the filtering processes being designed to localize sound images at rear positions symmetrical with respect to a listener when a rear loudspeaker is absent and only front loudspeakers are used, and means for generating the two-channel signals on the basis of the filtering-resultant signals;

wherein the filtering means comprises an adder for adding the left surround signal and the right surround signal into an addition-result signal, a subtracter for generating a subtraction-result signal representative of a difference between the left surround signal and the right surround signal, a first filter for processing the addition-result signal, and a second filter for processing the subtraction-result signal, the first filter and the second filter having filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

26. A recording apparatus for a surround signal processing program, comprising:

first means for encoding a surround signal processing program into an encoding-resultant signal having a form suited for record; and second means for recording the encoding-resultant signal generated by the first means on an information recording medium;

wherein the surround signal processing program includes a step for decoding a surround signal into multiple-channel signals, the multiple-channel signals including a left surround signal and a right surround signal, and a filtering step for subjecting the left surround signal and the right surround signal to filtering processes to convert the left surround signal and the right surround signal into filtering-resultant signals, the filtering processes being designed to localize sound images at rear positions symmetrical with respect to a listener when a rear loudspeaker is absent and only front loudspeakers are used; and wherein the filtering step includes the step of adding the left surround signal and the right surround signal into an addition-result signal, the step of generating a subtraction-result signal representative of a difference between the left surround signal and the right surround signal, the first sub filtering step of processing the addition-result signal, and the second sub filtering step of processing the subtraction-result signal, the first and second sub filtering steps providing filter coefficients P and N respectively which are set on the basis of transfer functions as follows:

$$P=(F+K)/(S+A)$$

$$N=(F-K)/(S-A)$$

where "S" denotes a transfer function from each of a pair of the loudspeakers to each listener's ear existing on the same side of each loudspeaker; "A" denotes a transfer function from each of a pair of the loudspeakers to each listener's ear existing on the opposite side of each loudspeaker; "F" denotes a transfer function from a position at which each sound image is required to be localized to each listener's ear existing on the same side of each loudspeaker; and "K" denotes a transfer function from a position at which each sound image is required to be localized to each listener's ear existing on the opposite side of each loudspeaker.

* * * * *